US010669701B2

(12) United States Patent
Hadfield et al.

(10) Patent No.: US 10,669,701 B2
(45) Date of Patent: Jun. 2, 2020

(54) SPRAY INDEXING MECHANISM FOR FAUCET

(71) Applicant: Kohler Co., Kohler, WI (US)

(72) Inventors: Brad R. Hadfield, Port Washington, WI (US); Perry D. Erickson, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 16/058,070

(22) Filed: Aug. 8, 2018

(65) Prior Publication Data

US 2020/0048879 A1 Feb. 13, 2020

(51) Int. Cl.
*E03C 1/04* (2006.01)

(52) U.S. Cl.
CPC ..... *E03C 1/0404* (2013.01)

(58) Field of Classification Search
CPC ..... E03C 1/0404
USPC ..... 4/678
See application file for complete search history.

(56) References Cited

U.S. PATENT DOCUMENTS

| | | | | |
|---|---|---|---|---|
| 6,446,278 | B1 | 9/2002 | Lin | |
| 6,877,172 | B2 | 4/2005 | Malek et al. | |
| 7,252,112 | B1 | 8/2007 | Imler et al. | |
| 7,699,241 | B2 | 4/2010 | Benstead | |
| 9,683,353 | B2 | 6/2017 | Myers et al. | |
| 9,797,118 | B2 | 10/2017 | Bosio | |
| 2015/0308088 | A1* | 10/2015 | Enlow | E03C 1/0404 137/1 |
| 2016/0083942 | A1* | 3/2016 | Li | E03C 1/0404 4/678 |
| 2016/0215482 | A1* | 7/2016 | Fourman | E03C 1/0404 |
| 2017/0350104 | A1* | 12/2017 | Clarke | E03C 1/0404 |

* cited by examiner

*Primary Examiner* — Huyen D Le
(74) *Attorney, Agent, or Firm* — Foley & Lardner LLP

(57) ABSTRACT

A faucet includes a spout, a spray hose, a support arm, and a sprayer. The spray hose is partially contained within the spout and extends from the spout. The support arm is coupled to the spout and extends from the spout. The sprayer includes a docking assembly and a spray head. The docking assembly is removably coupled to the support arm. The spray head assembly is rotatably coupled to the spray hose and rotatably coupled to the docking assembly. The docking assembly is configured to facilitate rotation of the spray head assembly relative to the docking assembly.

20 Claims, 15 Drawing Sheets

SPRAY INDEXING MECHANISM FOR FAUCET

TECHNICAL FIELD

The present application relates generally to spray heads for faucets. In particular, this application applies to systems for adjusting the spray head on a faucet.

BACKGROUND

Generally speaking, a faucet may include a spray head which is attached to a spray hose. The spray hose may extend from the spout of the faucet. The spray head may be rigidly coupled to the spray hose such that rotation of the spray head results in the rotation of the spray hose. As a result of this arrangement, the spray head may have a limited range of motion.

Additionally, a spray head may include a function button or a function toggle on an outside surface thereof. The function button or function toggle may have an orientation set on the outside surface by the manufacturer. As a result of this arrangement, the user may not be able to adjust the position of the function button or the function toggle during the lifetime of the product without either the use of tools or the need to replace the spray head. It would be beneficial to provide a spray head that is selectively rotatable relative to the spout.

SUMMARY

Embodiments described herein relate generally to faucets, and in particular to a system for adjusting the spray head of a faucet.

An embodiment of the present disclosure is related to a faucet. The faucet includes a spout, a spray hose, a support arm, and a sprayer. The spray hose is partially contained within the spout and extends from the spout. The support arm is coupled to the spout and extends from the spout. The sprayer includes a docking assembly and a spray head. The docking assembly is removably coupled to the support arm. The spray head assembly is rotatably coupled to the spray hose and rotatably coupled to the docking assembly. The docking assembly is configured to facilitate rotation of the spray head assembly relative to the docking assembly.

Another embodiment of the present disclosure is related to a faucet. The faucet includes a spout, a spray hose, a support arm, and a sprayer. The spray hose is partially contained within the spout and extends from the spout. The support arm is coupled to the spout and extends from the spout. The sprayer includes a docking assembly and a spray head. The docking assembly is removably coupled to the support arm. The spray head assembly is rotatably coupled to the spray hose and rotatably coupled to the docking assembly. The docking assembly is configured to facilitate rotation of the spray head assembly relative to the docking assembly. The spray head assembly is rotatable relative to the docking assembly without axial movement of the spray head assembly relative to the docking assembly and without translational movement of the spray head assembly relative to the docking assembly.

Yet another embodiment of the present disclosure is related to a sprayer. The sprayer includes a docking assembly and a spray head assembly. The docking assembly includes a retention device. The spray head assembly is configured to be rotatably coupled to a spray hose and rotatably coupled to the docking assembly. The docking assembly is configured to facilitate rotation of the spray head assembly relative to the docking assembly.

It should be appreciated that all combinations of the foregoing concepts and additional concepts discussed in greater detail below (provided such concepts are not mutually inconsistent) are contemplated as being part of the subject matter disclosed herein. In particular, all combinations of claimed subject matter appearing at the end of this disclosure are contemplated as being part of the subject matter disclosed herein. Both the foregoing general description and the following detailed description are exemplary and explanatory only and are not restrictive of the invention as claimed.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several implementations in accordance with the disclosure and are therefore, not to be considered limiting of its scope, the disclosure will be described with additional specificity and detail through use of the accompanying drawings.

DETAILED DESCRIPTION

Figure 1:
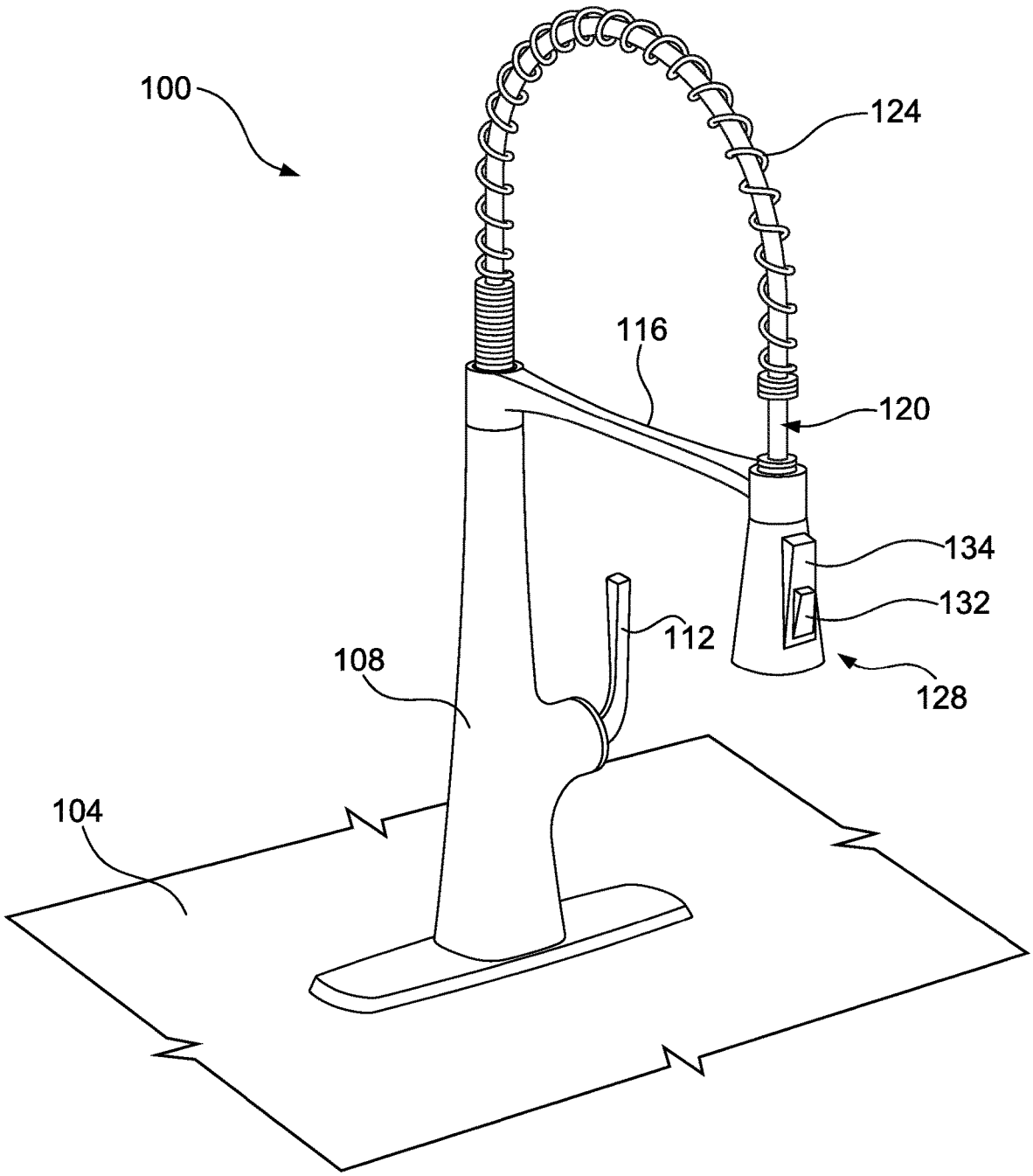
FIG. 1 is a front, left perspective view of a faucet, according to an embodiment.

Embodiments described herein relate generally to faucets, and in particular to a faucet spray head assembly that can be adjusted and/or oriented according to the preference of a user.

Before turning to the figures, which illustrate the exemplary embodiment in detail, it should be understood that the present application is not limited to the details or methodology set forth in the description or illustrated in the figures. It should also be understood that the terminology is for the purpose of description only and should not be regarded as limiting.

I. Overview

A faucet may include a sprayer for controlling a direction of a flow of water out of the faucet. The sprayer may be attached to an end of a flexible spray hose, adding a range of motion to the sprayer. The sprayer may be attached to a retractable flexible spray hose that retracts into either a spout that is part of the faucet; a hole in a surface, such as a countertop; or another structure that adds rigidity to the flexible spray hose, such as a large spring or a braided metal tube. The sprayer may include a function button on an outside surface of the sprayer that controls a pressure or a shape (e.g., shower, stream, jet, etc.) of the water coming from the sprayer. In addition to the function button, the sprayer may include a function toggle on the outside surface of the sprayer that controls the pressure or the shape of the water coming from the sprayer. During the life of the product, it may be desirable to change the orientation of the function button relative to the spout or to the flexible spray hose.

Some faucets are manufactured such that the flexible spray hose is rigidly coupled (e.g., fixed, fastened, etc.) to an asymmetric sprayer, such as a sprayer designed to be ergonomic or one that is curved to accomplish an aesthetic appeal. To change the orientation of the function button or the orientation of the function toggle on these embodiments would require that the flexible spray hose be detached from the sprayer and then reattached in a new orientation relative to the flexible spray hose. This adjustment would change the orientation of the sprayer in such a way that would affect the ergonomics and the visual appeal of the sprayer. In addition, such a change would require tools and basic knowledge of how to carry out such a task. Otherwise, a new sprayer would have to be purchased and installed that had the function button and/or the function toggle in the desired orientation relative to the flexible spray hose.

Some faucets are manufactured such that the flexible spray hose is rigidly coupled to a symmetrical sprayer that can be selectively coupled (e.g., docked, attached, etc.) to the spout in any number of different orientations. The sprayer can be decoupled from the spout, rotated a desirable amount of degrees with respect to the spout, and then recoupled in the new orientation such that the function button and/or function toggle is in a desirable position. This change in orientation causes the flexible spray hose to rotate with the sprayer. The flex in the flexible spray hose caused by the rotation of the flexible spray hose can apply an undesirable, and in some cases uncomfortable, torque on the sprayer when in use.

Some faucets are manufactured with a sprayer that can be removed from the spout with a twist. This uses the mechanical advantage of wedges to overcome the forces coupling the sprayer to the spout. Applying a rotational force causes the sprayer to detach from the spout. This twists the flexible spray hose, which can create an undesirable and uncomfortable torque on the sprayer. In addition, the sprayer of this embodiment can only be replaced in the same orientation from which it was removed. While docked (e.g., selectively coupled, attached, etc.) to the spout, the function button is still in the same orientation to the spout that it was before the sprayer was removed.

Various embodiments herein relate to a faucet that includes a sprayer that includes a docking assembly and a spray head assembly that are rotatably coupled to each other, allowing for the orientation of the function button and/or the function toggle on the spray head assembly to be adjusted relative to the flexible spray hose. By rotating the spray head assembly without rotating the flexible spray hose, undesirable torques are avoided. These various embodiments also allow for orientation adjustments of the function button/toggle without the need for tools or an understanding of faucets. Instead, the docking assembly uses a ratchet, which can be twisted by hand (e.g., without the need for additional tools, in a "tool-less" fashion, etc.), that facilitates (e.g., controls, guides, persuades, etc.) the rotation of the spray head assembly separate from the docking assembly. The ratchet only allows rotation in a single direction (e.g., clockwise, counterclockwise, etc.) to prevent the docking assembly and the spray head assembly from becoming loose, leaky, or disconnected over the lifetime of the faucet. Additionally, the embodiments utilize a wear washer to facilitate contact between the docking assembly and the spray head assembly to increase the longevity of the product and minimize product wear even after many cycles of function button/toggle orientation adjustment.

II. The Faucet Including a Docking Assembly and a Spray Head Assembly

Referring to FIG. 1, a faucet (e.g., semi-professional faucet, centerset faucet, sink faucet, bathroom faucet, etc.), shown as a faucet 100. The faucet 100 is configured to receive water (e.g., from a water supply pipe, etc.) and to selectively provide the water such that the water may be used to, for example, wash a user's hands or fill a basin with the water. In various embodiments, the faucet 100 separately receives a first water stream (e.g., hot water, etc.) and a second water stream (e.g., cold water, etc.) and is configured to provide a third water stream that is a user-defined mixture of the first water stream and the second water stream. In this way, a user may alter a temperature and/or flow rate (e.g., volumetric flow rate, etc.) of the third water stream.

The faucet 100 is mounted on a surface (e.g., countertop, deck, etc.), shown as a surface 104. In various embodiments, the surface 104 is a kitchen countertop such that the faucet 100 is capable of being utilized in a kitchen. The faucet 100 includes a spout (e.g., a body, a frame, a conduit, etc.), shown as a spout 108. The spout 108 protrudes from the surface 104. The spout 108 may be mounted flush against the surface 104 such that substantially no gap exists between the spout 108 and the surface 104. The spout 108 may be secured to the surface 104 through an interaction between the spout 108 and the surface 104. The spout 108 is coupled to a water supply pipe and configured to receive water (e.g., hot, cold, mixture, etc.) from the water supply pipe.

The faucet 100 also includes a handle (e.g., arm, lever, etc.), shown as a handle 112. The handle 112 may be selectively repositioned relative to the spout 108 to change a temperature and/or a flow rate of the water through the spout 108. The handle 112 is movably coupled to the spout 108.

The faucet 100 also includes a hose (e.g., flexible spray hose, spray tube, flexible tube, etc.), shown as a spray hose 120. The spray hose 120 is at least partially contained within the spout 108 and is configured to be selectively extended from the spout 108.

The faucet 100 also includes a spring (e.g., coil, supporting spring, etc.), shown as a external spring 124. The external spring 124 may be coupled to the spout 108. The external spring 124 is positioned around (e.g., disposed around, wrapped around, etc.) the spray hose 120. The external spring 124 may resist the movement of the spray hose 120 relative to the spout 108. Additionally, the external spring 124 may bias the spray hose to a target position.

The faucet 100 also includes a sprayer (e.g., spray head, spray handle, etc.), shown as a sprayer 128. The sprayer 128 may be removably coupled to the support arm 116 to hold the sprayer 128 in a target position relative to the spout 108. The spray hose 120 is at least partially contained within the sprayer 128. The spray hose 120 is rotatably coupled to the sprayer 128. The sprayer 128 is configured to receive the water from the spray hose 120. The sprayer 128 is configured to discharge (e.g., eject, dispense, etc.) water from one end of the sprayer 128.

Figure 2:
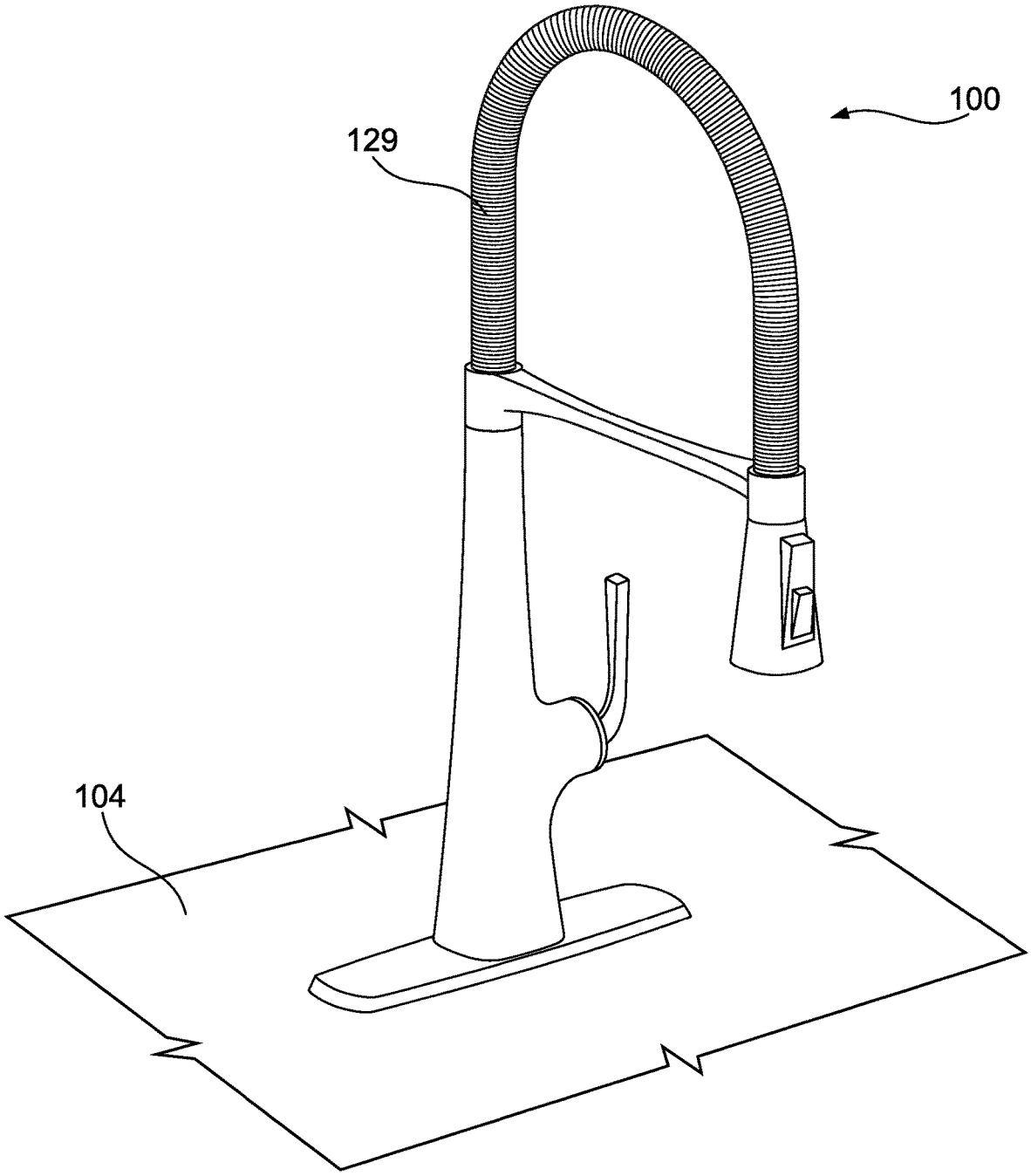
FIG. 2 is a front, left perspective view of the faucet including an ornamental spring, according to another embodiment.

Referring to FIG. 2, the faucet 100 may also include a spring (e.g., coil, spiral body, etc.), shown as an ornamental spring 129. The ornamental spring 129 is positioned between the sprayer 128 and the spout 108. The ornamental spring 129 is positioned around the external spring 124 and around the spray hose 120. The ornamental spring 129 may be coupled to the spout 108. In some embodiments, the ornamental spring 129 is coupled to the sprayer 128. In other embodiments, the ornamental spring is rotatably coupled to the sprayer 128.

Referring further to FIGS. 1 and 2, the faucet 100 also includes a function button (e.g., switch, toggle, interface, etc.), shown as a function button 132. The function button 132 is coupled to the sprayer 128 such that the function button 132 may be depressed (e.g., pressed, etc.) by a user. The function button 132 may be coupled to the sprayer 128 in any orientation on the outside of the sprayer 128. The function button 132 may be configured to change a function of the water, such as a pressure of the water or a shape (e.g., shower, stream, etc.) of the water.

The faucet 100 also includes a toggle (e.g., lever, switch, actuator, etc.), shown as a function toggle 134. The function toggle 134 may be configured to operate in tandem with the function button 132. The function toggle 134 may be configured to reverse the depression of the function button 132, returning the sprayer 128 to its original function. Alternatively, the function toggle 134 may be configured to change a function of the water flow that the function button 132 does not change, such as a pressure of the water or a shape of the water. The function toggle 134 may be disposed (e.g., located, positioned, etc.) on the sprayer 128 on the same side as the function button 132. In some embodiments, the function toggle 134 is disposed on the sprayer 128 on a different side than the function button 132.

As will be explained in greater detail herein, the sprayer 128 will include two sub-assemblies: a docking assembly and a spray head assembly. The docking assembly will be rotatably coupled to the spray head assembly, facilitating the selective rotation of the spray head assembly relative to the docking assembly. The spray head assembly will also include the function button 132 and the function toggle 134. When the spray head assembly is rotated, the function button 132 and the function toggle 134 will rotate simultaneously and orient in conjunction with the spray head assembly. The spray hose 120, which is selectively coupled to the sprayer 128, may be configured to remain stationary (e.g., not rotate, etc.) when the spray head assembly is rotated. As a result, the function button 132 and the function toggle 134 can be oriented to a desirable location for aesthetics, ergonomics, or other user wants and needs. Also, because the spray hose 120 does not rotate with the sprayer 128, the spray hose 120 will be arrested (e.g., prevented, halted, incapable of at least temporarily, etc.) from applying torque to the sprayer 128.

III. A Faucet According to an Exemplary Embodiment

Figure 3:
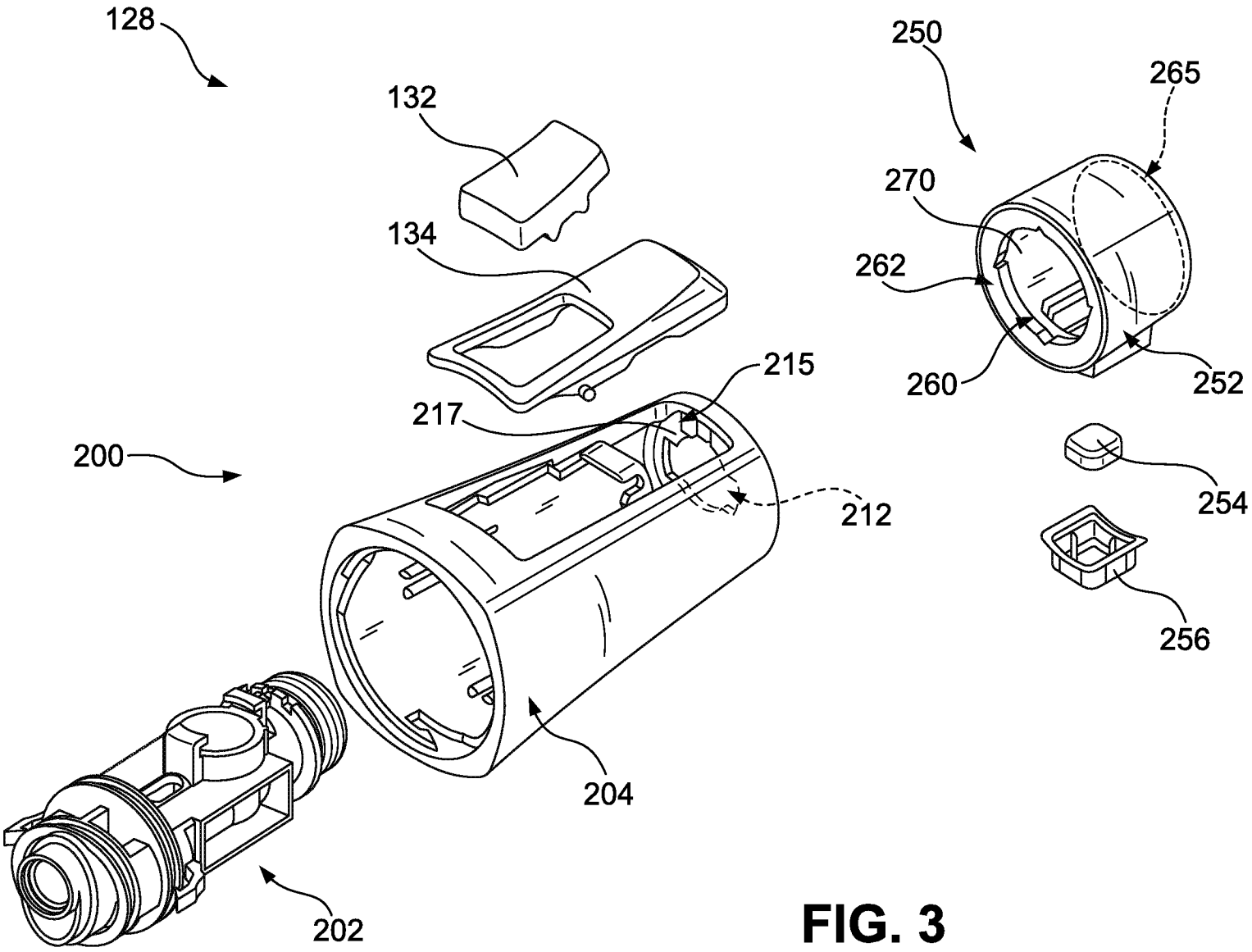
FIG. 3 is an exploded perspective view of a sprayer of the faucet, according to an embodiment.

FIGS. 1-14 illustrate a faucet 100 according to an exemplary embodiment. As shown in FIG. 3, the faucet 100 includes an assembly (e.g., a group of components, a system, a collection of parts, etc.), shown as a spray head assembly 200. The spray head assembly 200 is configured to (e.g., structured to, capable of, etc.) accept (e.g., receive, etc.) a flow of water from the spray hose 120. The spray head assembly 200 may be further configured to control a water direction, a water shape, and/or a water flow rate. The spray head assembly 200 may be further configured to stop (e.g., halt, pause, arrest, etc.) the flow of water out of the sprayer 128. The spray head assembly 200 may be further configured to discharge (e.g., eject, etc.) the water in any of a plurality of directions relative to the spout 108. The spray head assembly 200 may be further configured to accept additional attachments, such as nozzles.

The spray head assembly 200 includes a component (e.g., part, piece, apparatus, etc.), shown as a spray diverter 202. The spray diverter 202 is configured to accept a flow of water from the spray hose 120. The spray diverter 202 may be configured to be controlled by the function button 132 and controlled by the function toggle 134. The spray diverter 202 may be configured to stop the flow of water out of the sprayer 128. The spray diverter 202 is disposed in a body (e.g., housing, case, shell, frame, etc.), shown as a spray head housing 204. In various embodiments, the function button 132 and the function toggle 134 are disposed on the spray head housing 204. The spray head housing 204 is configured to be selectively interfaced by a user. The spray head housing 204 may be manufactured (e.g., made, built, fabricated, etc.) from plastic, stainless steel, or any other metal alloy. The spray head housing 204 may be manufactured to reach an aesthetic appeal.

The spray head housing 204 includes an aperture (e.g., opening, hole, gap, etc.), shown as a spray aperture 212. The spray aperture 212 is configured to receive the spray diverter 202. The spray diverter 202 is configured to extend out of the spray aperture 212.

The spray aperture 212 includes a flange (e.g., an extrusion, a projection, additional material, etc.), shown as a spray annular flange 215. The spray annular flange 215 is configured to be structurally integrated with the spray head housing 204. In some embodiments, the spray annular flange 215 may be coupled to the spray head housing 204. The spray annular flange 215 is disposed around (e.g., positioned around, wrapped around, etc.) the spray diverter 202 and coupled to the spray diverter 202. The spray annular flange 215 includes a surface (e.g., face, area, exterior, etc.), shown as a spray flange underside 217. The spray flange underside 217 is configured to interface with the spray diverter 202 to prevent the movement of the spray head housing 204 relative to the spray diverter 202. The spray flange underside 217 abuts a surface of the spray diverter 202.

The faucet 100 also includes an assembly, shown as a docking assembly 250. The docking assembly 250 is configured to facilitate the rotational orientation (e.g., position, location, etc.) of the spray head assembly 200 relative to the docking assembly 250. The docking assembly is also configured to removably couple the sprayer 128 to the support arm 116. The docking assembly 250 includes a body, shown as a docking housing 252. The docking housing 252 is configured to facilitate the orientation of the spray head assembly 200 relative to the docking assembly 250. The docking housing 252 is further configured to arrest (e.g., pause, halt, etc.) the rotation of the spray head assembly 200 relative to the docking assembly 250 in a single rotational direction (e.g., clockwise, counterclockwise, etc.).

The docking housing 252 is configured to be removably coupled (e.g., movably coupled, detachably coupled, etc.) to the support arm 116 using a retention mechanism (e.g., mounting device, etc.), shown as a magnet 254. The magnet 254 is configured to interface with the support arm 116 such that the docking housing 252 can be removed from the support arm 116 without the need for tools (e.g., in a "tool-less" fashion, etc.). The magnet 254 is coupled to the docking housing 252 using a body, shown as a docking nut 256. The docking nut 256 is disposed around the magnet 254. The docking nut is coupled to the docking housing 252. The docking nut 256 is configured to keep the magnet 254 coupled to the docking housing 252 while the magnet 254 is under load (e.g., while forces are applied to the magnet). In some embodiments, the magnet 254 is allowed to move within the docking nut 256 relative to the docking housing 252. In other embodiments, the docking nut 256 couples to the magnet to the spray head housing 204.

The docking housing 252 also includes an aperture, shown as a docking bottom aperture 260. The docking bottom aperture 260 is configured to receive at least a portion of the spray diverter 202. The docking bottom aperture 260 also includes a flange, shown as an docking annular flange 262. The docking annular flange 262 is disposed around at least a portion of the spray diverter 202. The docking annular flange 262 is structurally integrated with the docking housing 252. In other embodiments, the docking annular flange 262 may be coupled to the docking housing 252.

The docking housing 252 also includes an aperture, shown as a docking top aperture 265. The docking top aperture 265 is configured to receive at least a portion of the spray hose 120. The docking top aperture 265 includes a surface, shown as a docking inner surface 270. The docking inner surface 270 is contiguous with the docking annular flange 262. In various embodiments, the docking inner surface 270 is interrupted by at least one of the magnet 254 or the docking nut 256.

The spray hose 120 includes an end (e.g., a part, a surface, a portion, etc.), shown as a first spray hose end 290. The first spray hose end 290 is configured to extend into the sprayer 128 through the docking top aperture 265. The first spray hose end 290 is configured to receive a flow of water from the spray hose 120. The first spray hose end 290 is further configured to deliver a flow of water to the sprayer 128.

Figure 4:
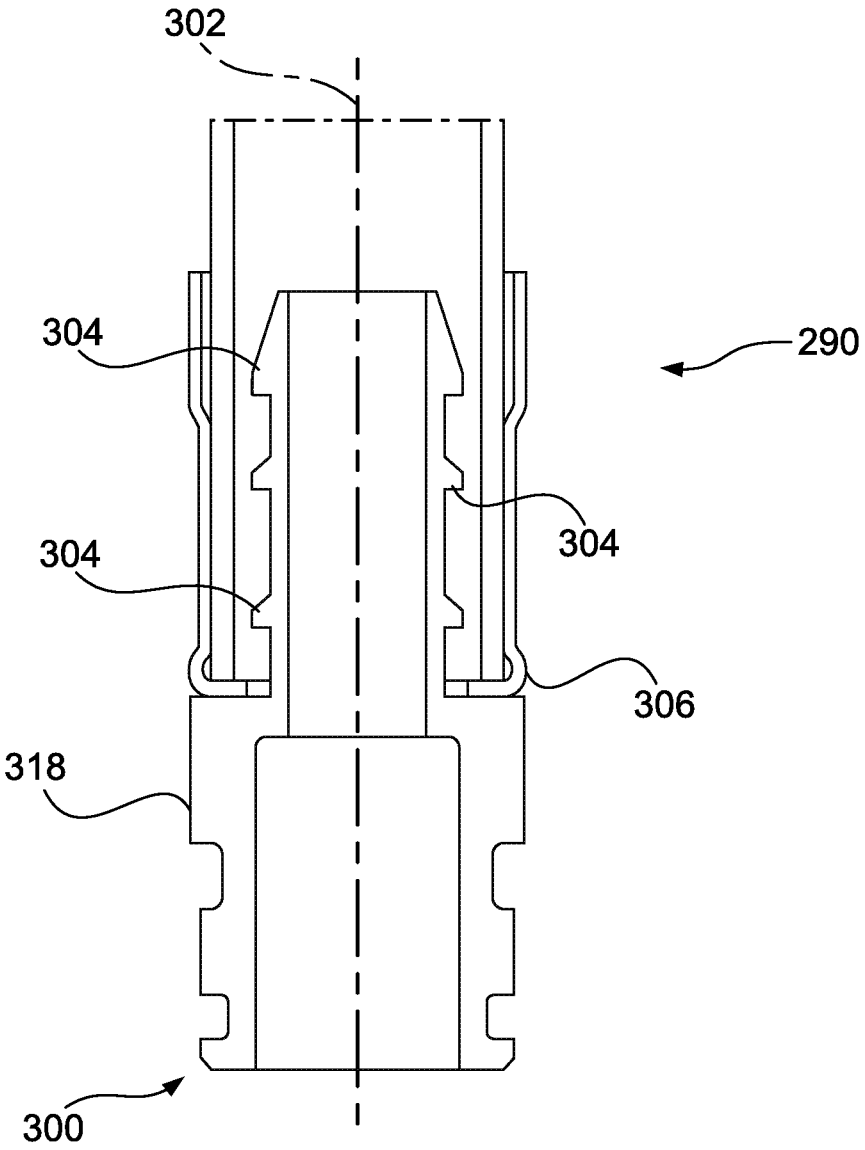
FIG. 4 is a cross-sectional view of a portion of a spray hose included in the sprayer of FIG. 3.

Referring to FIG. 4, the spray hose 120 includes a retention device (e.g., retainer, clamp, coupling, etc.), shown as a spray hose retainer 300. The spray hose retainer 300 is configured to extend into the first spray hose end 290. The spray hose retainer 300 is configured to accept a flow of water from the spray hose 120. The spray hose retainer 300 is configured to deliver a flow of water to the sprayer 128. The spray hose retainer 300 is disposed in the docking housing 252. In some embodiments, the spray hose retainer 300 extends out of the docking housing 252 through at least one of the docking top aperture 265 or the docking bottom aperture 260.

The spray hose retainer 300 is centered on a center axis (e.g., center line, etc.), shown as a center axis 302. The center axis 302 extends through a centroid (e.g., center of mass, etc.) of the spray hose retainer 300. The spray hose retainer 300 includes a plurality of protrusions (e.g., projections, flanges, etc.), shown as protrusions 304. Each of the protrusions 304 is configured to grip an interior surface of the spray hose 120 and cooperatively prevent the spray hose 120 from separating from the spray hose retainer 300 under axial loads (e.g., forces with a component along the center axis 302, etc.). The spray hose 120 also includes a collar (e.g., sleeve, shell, etc.), shown as a clamping collar 306. The clamping collar 306 is positioned around the first spray hose end 290, the spray hose retainer 300, and the protrusions 304. The clamping collar 306 is configured to squeeze (e.g., compress, clamp, etc.) the spray hose 120 inward toward the protrusions 304 such that the protrusions 304 rigidly couple the spray hose 120 to the spray hose retainer 300.

The spray hose 120 also includes a second spray hose end (not shown). The second spray hose end is opposite the first spray hose end 290. The second spray hose end extends into the spout 108 and may be rotatably coupled to the spout 108. The second spray hose end is configured to receive a flow of water from the spout 108. The second spray hose end is configured to deliver a flow of water to the spray hose 120. In some embodiments, the second spray hose end is rigidly coupled to the spout 108. In other embodiments, the second spray hose end is threadably coupled to the spout 108.

Figure 5:
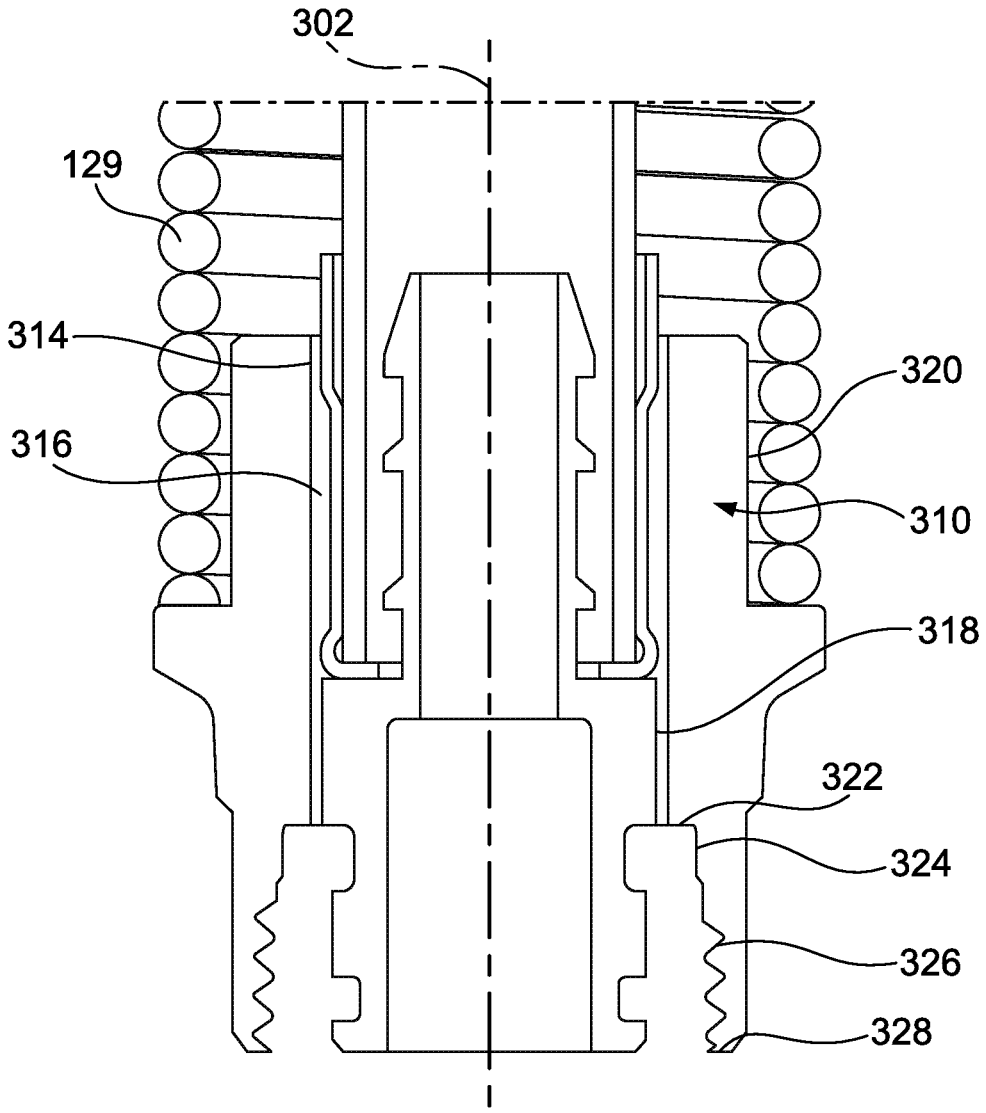
FIG. 5 is a cross-sectional view of a portion of a spray head assembly included in the sprayer of FIG. 3.

Referring to FIG. 5, the faucet 100 also includes a body, shown as a spray nut 310. The spray nut 310 is disposed within the docking housing 252. The spray nut 310 rotatably couples the spray hose retainer 300 to the sprayer 128. The spray nut 310 includes an aperture, shown as a spray nut top aperture 314. The spray nut top aperture 314 is configured to receive the spray hose retainer 300, the first spray hose end 290, and the clamping collar 306. The spray nut top aperture 314 includes an annular surface (e.g., round surface, curved surface), shown as a spray nut inner surface 316. The spray nut inner surface 316 is configured to selectively interface with an annular surface of the spray hose retainer 300, shown as a first retainer outer surface 318, such that slipping (e.g., sliding, rubbing, etc.) is allowed. In some embodiments, the spray hose retainer 300 protrudes out of the spray nut 310 through the spray nut top aperture 314.

The spray nut 310 also includes a surface, shown as a first engagement surface 320. The first engagement surface 320 is configured to extend into the ornamental spring 129. The first engagement surface 320 is configured to interface with a surface of the ornamental spring 129. The first engagement surface 320 may be coupled to the ornamental spring 129. In various embodiments, at least a portion of the first engagement surface 320 is threaded.

The spray nut 310 also includes a surface, shown as a first annular surface 322. The first annular surface 322 is contiguous with the spray nut inner surface 316. The spray nut 310 also includes a surface, shown as a second annular surface 324. The second annular surface 324 is contiguous with the first annular surface 322. The spray nut 310 also includes a surface, shown as a second engagement surface 326. The second engagement surface 326 is contiguous with the second annular surface 324. In various embodiments, at least a portion of the second engagement surface 326 is threaded.

The second engagement surface 326 is disposed within an aperture, shown as a spray nut bottom aperture 328. The spray nut bottom aperture 328 is configured to accept the spray diverter 202.

Figure 6:
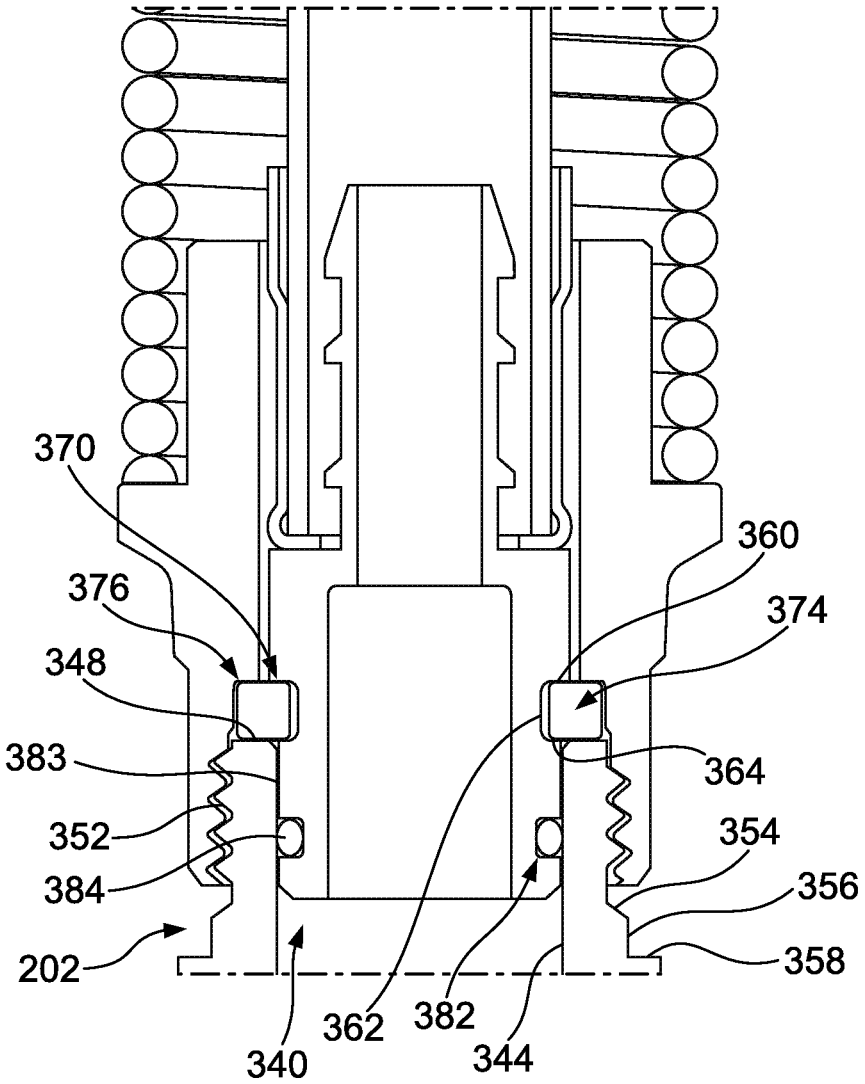
FIG. 6 is a cross-sectional view of a portion of the spray head assembly included in the sprayer of FIG. 3.

Referring to FIG. 6, the spray diverter 202 includes an aperture, shown as a diverter top aperture 340. The diverter top aperture 340 is configured to accept the spray hose retainer 300. The diverter top aperture 340 includes an annular surface, shown as a diverter inner surface 344. The diverter inner surface 344 is configured to interface with the spray hose retainer 300 such that slipping is allowed between the diverter inner surface 344 and the spray hose retainer 300.

The spray diverter 202 includes an surface, shown as a diverter lead surface 348. The diverter lead surface 348 is contiguous with the diverter inner surface 344. In some embodiments, the diverter lead surface 348 is parallel to the first annular surface 322. In other embodiments, the diverter lead surface 348 is concentric about the center axis 302. The spray diverter 202 also includes a surface, shown as a third engagement surface 352. The third engagement surface 352 is contiguous with the diverter lead surface 348. The third engagement surface 352 is configured to interface with the second engagement surface 326. In some embodiments, the third engagement surface 352 is coupled to the second engagement surface 326. In various embodiments, at least a portion of the third engagement surface 352 is threaded.

The spray diverter 202 also includes a surface, shown as a diverter taper 354. The diverter taper 354 is contiguous with the third engagement surface 352. In some embodiments, the diverter taper 354 is configured to interface with the spray nut 310.

The spray diverter 202 also includes a surface, shown as a diverter annular surface 356. The diverter annular surface 356 is contiguous with the diverter taper 354. The diverter annular surface 356 is configured to interface with the spray annular flange 215. In some embodiments, the diverter annular surface 356 may be concentric about the center axis 302. In similar embodiments, the diverter annular surface 356 is coupled to the spray head housing 204.

The spray diverter 202 also includes a surface, shown as a diverter shelf 358. The diverter shelf 358 is contiguous with the diverter annular surface 356. The diverter shelf 358 is configured to interface with the spray annular flange 215. The diverter shelf 358 abuts the spray flange underside 217 such that the spray head housing 204 cannot move axially along the center axis 302 relative to the spray diverter 202. The diverter shelf 358 is also coupled to the spray flange underside 217 such that rotational movement of the diverter shelf 358 radially about the center axis 302 results in the simultaneous rotation of the spray head housing 204 radially about the center axis 302. In some embodiments, the diverter shelf 358 is interrupted by notches (e.g., voids, cut-outs, divots, recesses, etc.).

The spray hose retainer 300 also includes a surface, shown as a first groove surface 360. The first groove surface 360 is contiguous with the first retainer outer surface 318. The spray hose retainer 300 also includes a surface, shown as a second groove surface 362. The second groove surface 362 is contiguous with the first groove surface 360. In some embodiments, the second groove surface 362 is concentric (e.g., sharing the same center line, etc.) with the first retainer outer surface 318. The spray hose retainer 300 also includes a surface, shown as third groove surface 364. The third groove surface 364 is contiguous with the second groove surface 362. In some embodiments, the third groove surface 364 is parallel to the first groove surface 360.

The first groove surface 360, the second groove surface 362, and the third groove surface 364 cooperate to define a groove, shown as a first retainer groove 370. The first retainer groove 370 abuts the spray nut 310 and the spray diverter 202. The first retainer groove 370 is configured to accept an annular body (e.g., ring, circular body, annular component, etc.), shown as a lock ring 374. The lock ring 374 is disposed within the first retainer groove 370 such that the lock ring 374 interfaces with the second groove surface 362. The lock ring 374 may be configured to allow slipping between the lock ring 374 and the second groove surface 362. In some embodiments, the lock ring 374 may be coupled to the first retainer groove 370 such that movement of the spray hose retainer 300 results in the simultaneous movement of the lock ring 374. The lock ring 374 is also configured to selectively interface with the first groove surface 360 and the third groove surface 364 such that the lock ring 374 is arrested from movement axially along the center axis 302 relative to the spray hose retainer 300. In some embodiments, the lock ring 374 is allowed to move axially along the center axis 302 relative to the spray hose retainer 300 within the first retainer groove 370 (e.g., the lock ring 374 is able to be disposed between the first groove surface 360 and the third groove surface 364 while still interfacing with the second groove surface 362).

Figure 7:
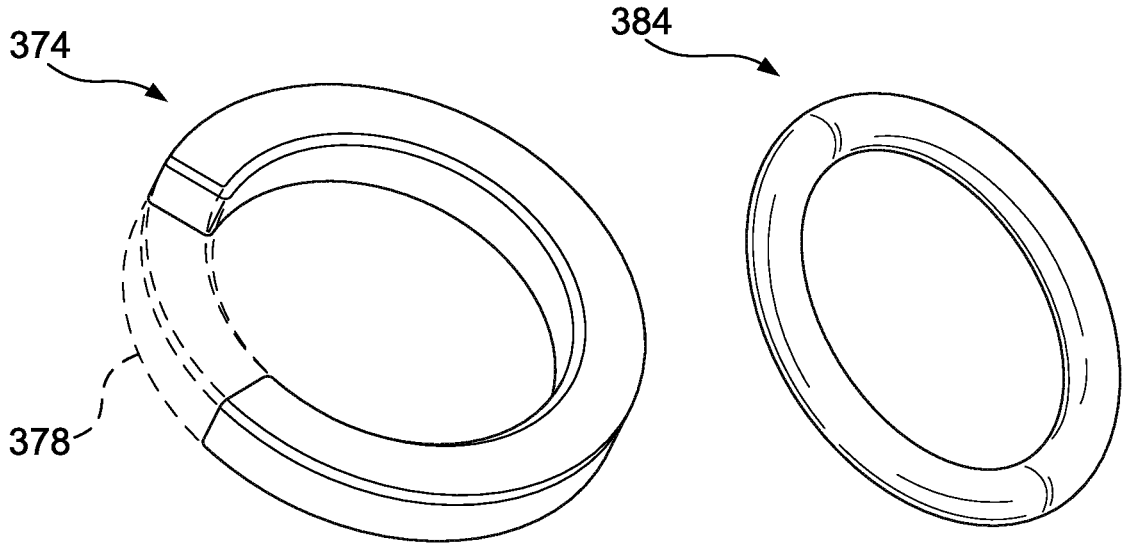
FIG. 7 is a perspective view of portions of the spray head assembly included in the sprayer of FIG. 3.

Referring to FIGS. 6 and 7, the first retainer groove 370 is configured to cooperate with the first annular surface 322, the second annular surface 324, and the diverter lead surface 348 to define a groove, shown as a ring groove 376. The ring groove 376 is configured to accept the lock ring 374. The lock ring 374 is configured to interface with the first annular surface 322, the second annular surface 324, and the diverter lead surface 348. The lock ring 374 is configured to arrest axial movement of the spray hose retainer 300 along the center axis 302 relative to the spray nut 310 and relative to the spray diverter 202.

The lock ring 374 includes an aperture, shown as a lock ring gap 378. The lock ring gap 378 is configured to interrupt the annular profile (e.g., shape, outline, geometry, etc.) of the lock ring 374. The lock ring gap 378 is configured to allow the lock ring 374 to be disposed on a body, such as the spray hose retainer 300. In some embodiments, the lock ring 374 is coupled to the ring groove 376. In similar embodiments, the lock ring 374 is able to slide in relation to the first annular surface 322, the second annular surface 324, and the diverter lead surface 348.

The spray hose retainer 300 also includes a groove, shown as a second retainer groove 382. The second retainer groove 382 is disposed within the diverter top aperture 340. The second retainer groove 382 is configured to interrupt a surface of the spray hose retainer 300, shown as a second retainer outer surface 383. The second retainer outer surface 383 is concentric with the first retainer outer surface 318. The second retainer outer surface 383 is contiguous with the third groove surface 364.

The second retainer groove 382 is configured to accept a seal (e.g., gasket, rubber seal, O-ring, etc.), shown as an O-ring 384. The O-ring 384 is configured to be received by the second retainer groove 382. The O-ring 384 is configured to interface with the second retainer groove 382 and the diverter inner surface 344 to create a water-tight seal (e.g., a seal not allowing water to pass through, etc.) such that the flow of water is arrested from interfacing with the lock ring 374 or the ring groove 376.

Figure 8:
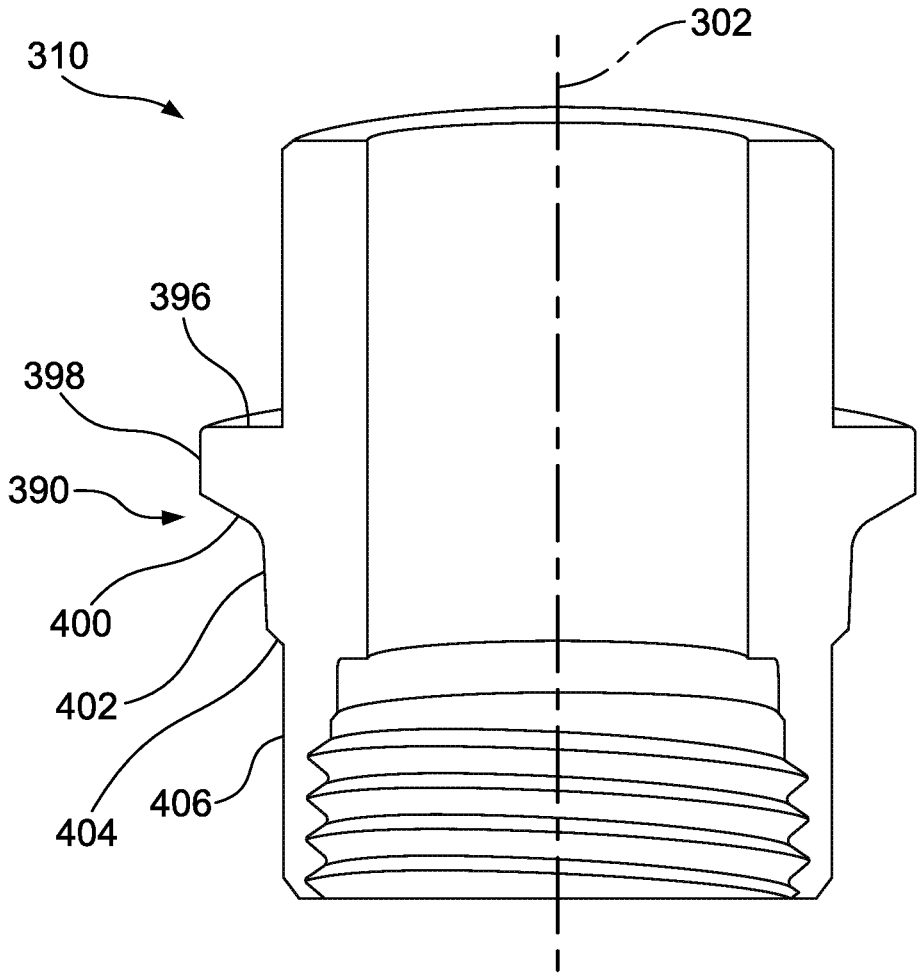
FIG. 8 is a cross-sectional view of a portion of the spray head assembly included in the sprayer of FIG. 3.

Referring to FIG. 8, the spray nut 310 also includes a flange, shown as spray nut flange 390. The spray nut flange 390 is configured to slidably interface with the docking inner surface 270. In some embodiments, the spray nut flange 390 is configured to separate the docking inner surface 270 from the ornamental spring 129. In other embodiments, the spray nut flange 390 is configured to act as a stop (e.g., a surface, etc.) for the ornamental spring 129 when the ornamental spring 129 is threaded onto the first engagement surface 320.

The spray nut flange 390 includes a surface, shown as a spray nut shoulder 396. The spray nut shoulder 396 is contiguous with the first engagement surface 320. In some embodiments, the spray nut shoulder 396 is configured to interface with the ornamental spring 129.

The spray nut flange 390 also includes a surface, shown as a first annular flange surface 398. The first annular flange surface 398 is contiguous with the spray nut shoulder 396. The first annular flange surface 398 is configured to selectively interface with the docking inner surface 270 such that slipping is allowed between the first annular flange surface 398 and the docking inner surface 270. In some embodiments, the first annular flange surface 398 is concentric with the center axis 302.

The spray nut flange 390 also includes a surface, shown as a first taper 400. The first taper 400 is contiguous with the first annular flange surface 398. In some embodiments, the first taper 400 slopes toward the center axis 302.

The spray nut flange 390 also includes a surface, shown as a second annular flange surface 402. The second annular flange surface 402 is contiguous with the first taper 400. In some embodiments, the second annular flange surface 402 is concentric with the center axis 302.

The spray nut flange 390 includes a surface, shown as a second taper 404. The second taper 404 is contiguous with the second annular flange surface 402. In some embodiments, the second taper 404 slopes toward the center axis 302. The second taper 404 is also contiguous with an outside surface of the spray nut 310, shown as a spray nut outer surface 406.

Figure 9:
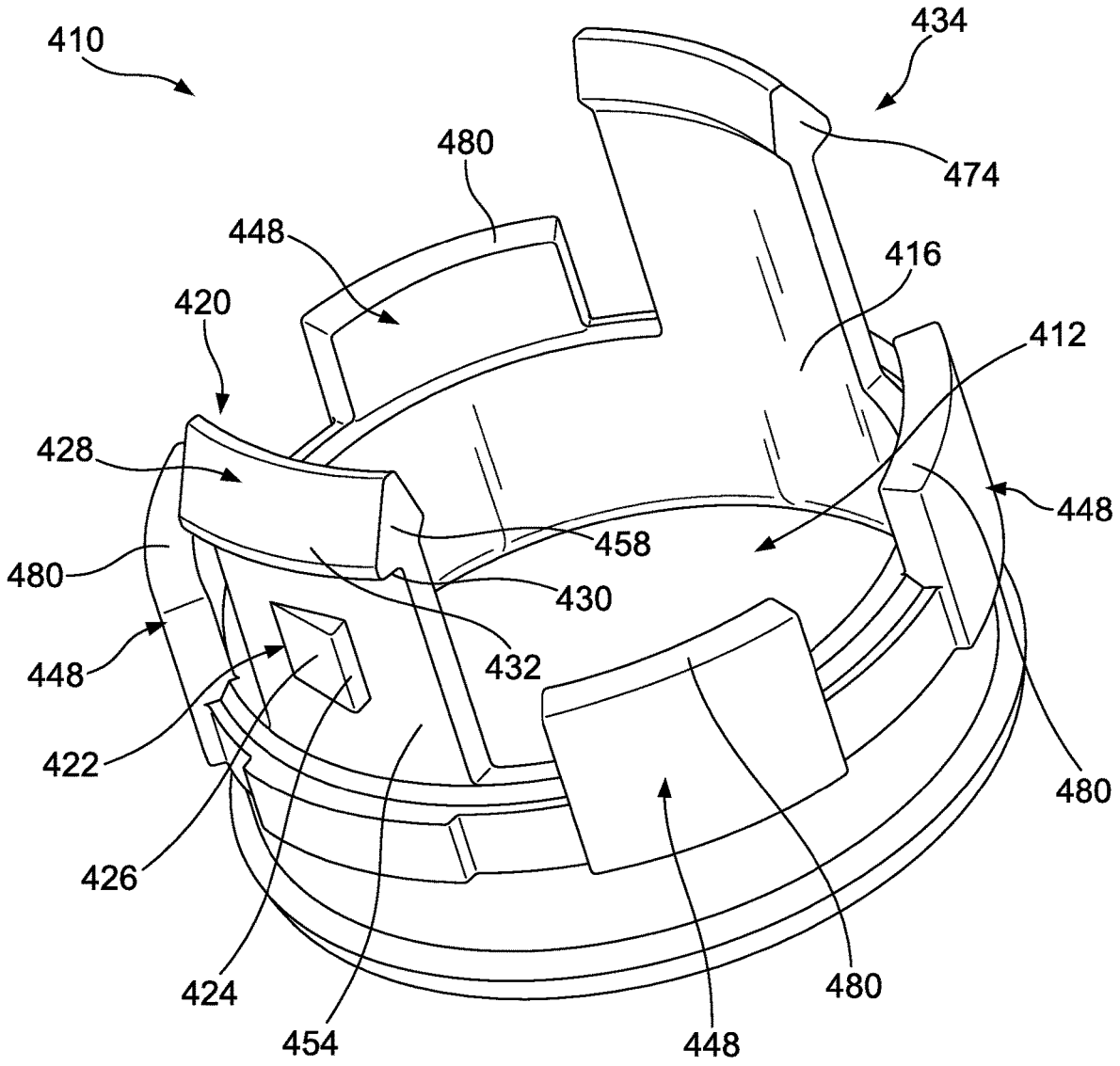
FIG. 9 is a perspective view of a portion of the spray head assembly included in the sprayer on FIG. 3.
Figure 10:
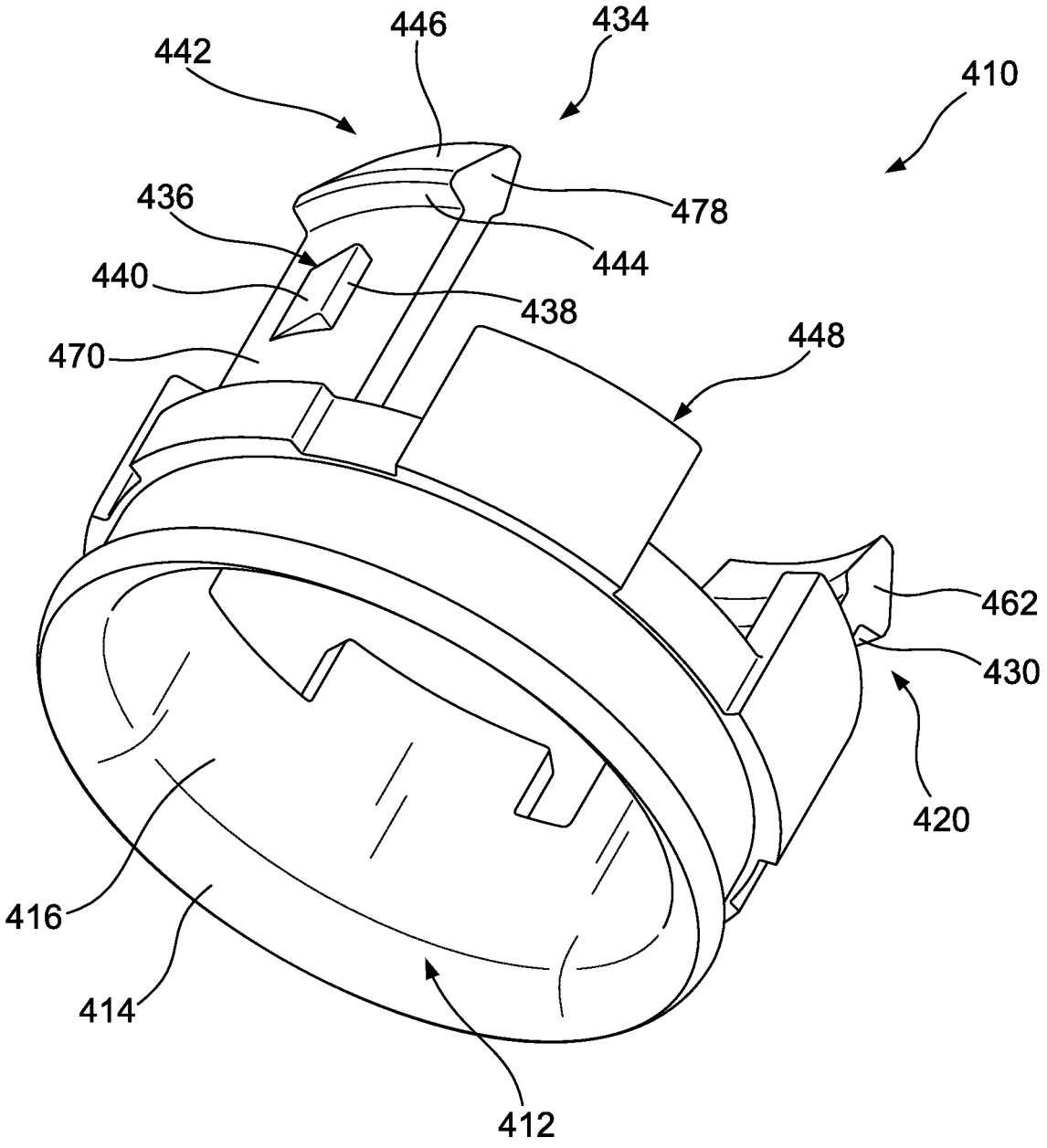
FIG. 10 is a rear perspective view of the portion of the spray head shown in FIG. 9.

Referring to FIGS. 9 and 10, the spray head assembly 200 also includes an annular body, shown as a ratchet 410. The ratchet 410 is disposed within the docking housing 252. The ratchet 410 extends into the spray head housing 204 and past the spray annular flange 215. The ratchet 410 is configured to cooperate with the docking housing 252 to facilitate the orientation of the spray head assembly 200. The ratchet 410 is further configured to rotatably couple the spray head housing 204 to the docking housing 252 such that the spray head housing 204 is arrested from axial movement along the center axis 302 relative to the docking housing 252. The ratchet 410 is further configured to interface with the docking assembly 250 to allow rotation of the spray head assembly 200 in a single rotational direction (e.g., counterclockwise, clockwise, etc.). The ratchet 410 is further configured to separate the docking housing 252 from the spray nut 310.

The ratchet 410 includes an aperture, shown as a ratchet aperture 412. The ratchet aperture 412 is configured to receive the spray nut 310 and to receive the spray hose retainer 300. The ratchet aperture 412 defines a surface, shown as a ratchet taper 414. The ratchet taper 414 is configured to be coupled to the first taper 400 such that movement of the first taper 400 simultaneously causes movement of the ratchet taper 414. The ratchet aperture 412 also defines a surface, shown as a ratchet inner surface 416. At least a portion of the ratchet inner surface 416 abuts the second annular flange surface 402 such that movement of the second annular flange surface 402 results in the simultaneous movement of the ratchet inner surface 416. The ratchet inner surface 416 is contiguous with the ratchet taper 414. In some embodiments, the ratchet inner surface 416 is coupled to the second annular flange surface 402.

The ratchet 410 also includes a biasing member (e.g., spring finger, cantilever beam, latch, clip, snap, etc.), shown as a first biasing member 420. The first biasing member 420 is configured to rotatably couple the spray head assembly 200 to the docking assembly 250 such that the spray head assembly 200 is arrested from axial movement along the center axis 302 relative to the docking assembly 250. The first biasing member 420 is further configured to cooperate with the docking housing 252 to facilitate the rotational orientation of the docking assembly 250 to the spray head assembly 200. The first biasing member 420 extends out of the docking housing 252 and into the spray head housing 204. The first biasing member 420 is coupled to the spray annular flange 215.

The first biasing member 420 includes a projection (e.g., protrusion, bump, hump, etc.), shown as a first ramped projection 422. The first ramped projection 422 is configured to interface with the docking housing 252 to facilitate the rotation of the spray head assembly 200 relative to the docking assembly 250. The first ramped projection 422 includes a surface, shown as a first projection flat surface 424. The first projection flat surface 424 is configured to interface with the docking annular flange 262 such that rotation of the spray head assembly 200 is only allowed in a single direction relative to the docking assembly 250.

The first ramped projection 422 also includes a surface, shown as a first projection ramped surface 426. The first projection ramped surface 426 is contiguous with the first projection flat surface 424. The first projection ramped surface 426 is configured to interface with the docking annular flange 262.

The first biasing member 420 also includes a flange, shown as a first flange 428. The first flange 428 is configured to latch onto (e.g., clip onto, hook onto, attach onto, etc.) the spray head housing 204 such that the spray head housing 204 cannot move axially along the center axis 302 relative to the docking assembly 250. The first flange 428 includes a surface, shown as a first top flange surface 430. The first top flange surface 430 abuts the spray flange underside 217. The first flange 428 also includes a surface, shown as a first flange ramped surface 432. The first flange ramped surface 432 is configured to interface with the spray annular flange 215. The first flange ramped surface 432 is contiguous with the first top flange surface 430.

The ratchet 410 also includes a biasing member, shown as a second biasing member 434. The second biasing member 434 is configured to rotatably couple the spray head assembly 200 to the docking assembly 250 such that the spray head assembly 200 is arrested from axial movement along the center axis 302 relative to the docking assembly 250. The second biasing member 434 is further configured to cooperate with the docking housing 252 to facilitate the rotational orientation of the docking assembly 250 to the spray head assembly 200. The second biasing member 434 extends out of the docking housing 252 ratchet and into the spray head housing 204. The second biasing member 434 is coupled to the spray annular flange 215.

The second biasing member 434 includes a projection, shown as a second ramped projection 436. The second ramped projection 436 is configured to interface with the docking housing 252 to facilitate the rotation of the spray head assembly 200 relative to the docking assembly 250. The second ramped projection 436 includes a surface, shown as a second projection flat surface 438. The second projection flat surface 438 is configured to interface with the docking annular flange 262 such that rotation of the spray head assembly 200 is only allowed in a single direction relative to the docking assembly 250.

The second ramped projection 436 also includes a surface, shown as a second projection ramped surface 440. The second projection ramped surface 440 is contiguous with the second projection flat surface 438. The second projection ramped surface 440 is configured to interface with the docking annular flange 262.

The second biasing member 434 also includes a flange, shown as a second flange 442. The second flange 442 is configured to latch onto the spray head housing 204 such that the spray head housing 204 is arrested from axial movement relative to the docking assembly 250. The second flange 442 includes a surface, shown as a second top flange surface 444. The second top flange surface 444 is configured to interface with the spray annular flange 215. The second flange 442 also includes a surface, shown as a second flange ramped surface 446. The second flange ramped surface 446 is contiguous with the second top flange surface 444.

The ratchet 410 further comprises a plurality of support members (e.g., legs, feet, lugs, support projections, etc.), shown as support members 448. Each of the support members 448 project axially from the ratchet 410. Each of the support members 448 is configured to interface with the docking annular flange 262 such that each of the plurality of support members 448 is disposed within the docking housing 252. Each of the plurality of support members 448 is further configured to prevent the movement of the ratchet 410 axially along the center axis 302 relative to the spray head assembly 200 and relative to the docking assembly 250. In some embodiments, each of the support members 448 is configured to selectively interface with the docking inner surface 270 such that sliding is allowed between each of the support members 448 and the docking inner surface 270.

Figure 11:
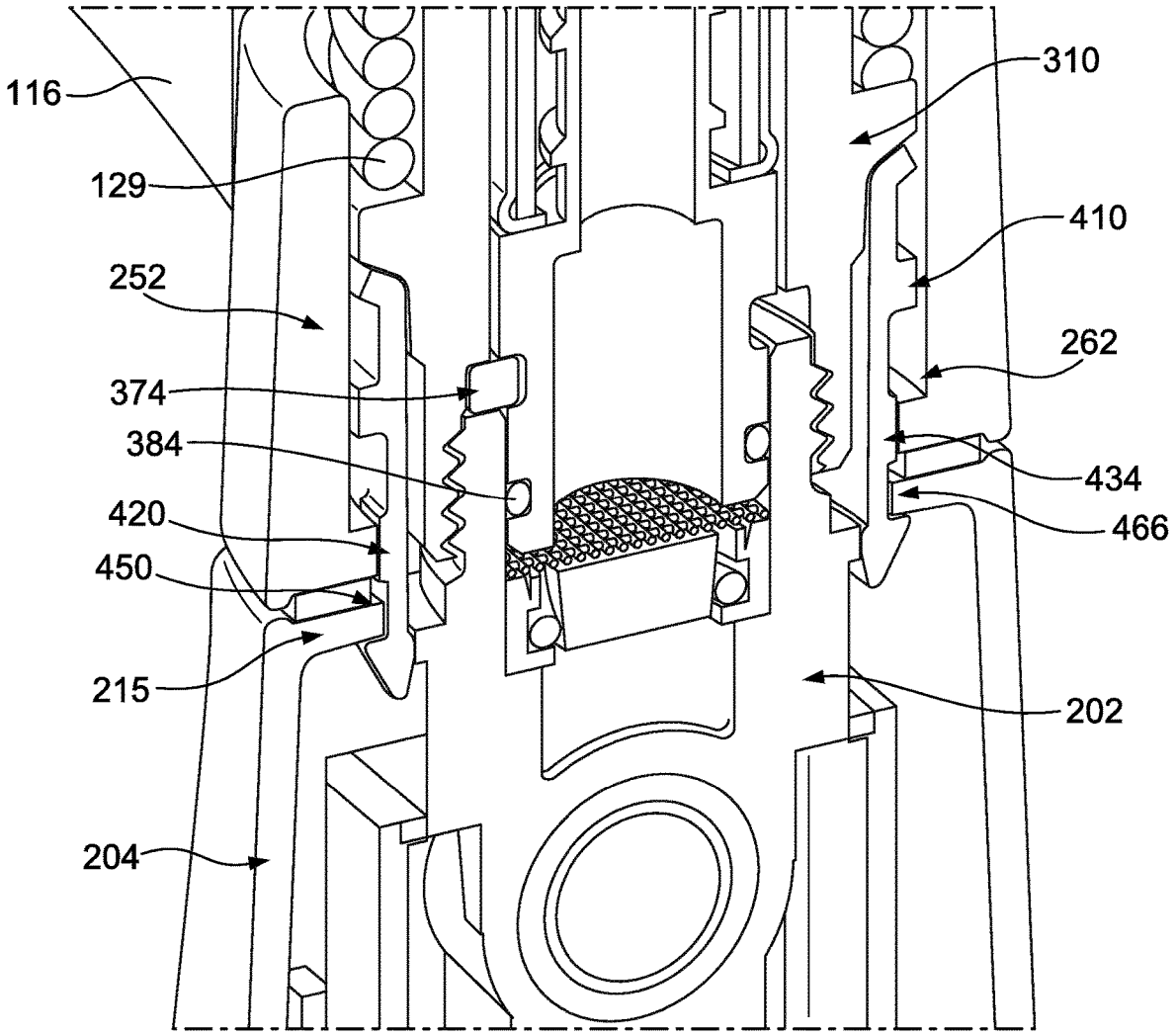
FIG. 11 is a perspective, cross-sectional view of an interface between the spray head assembly and the docking assembly of FIG. 3.
Figure 12:
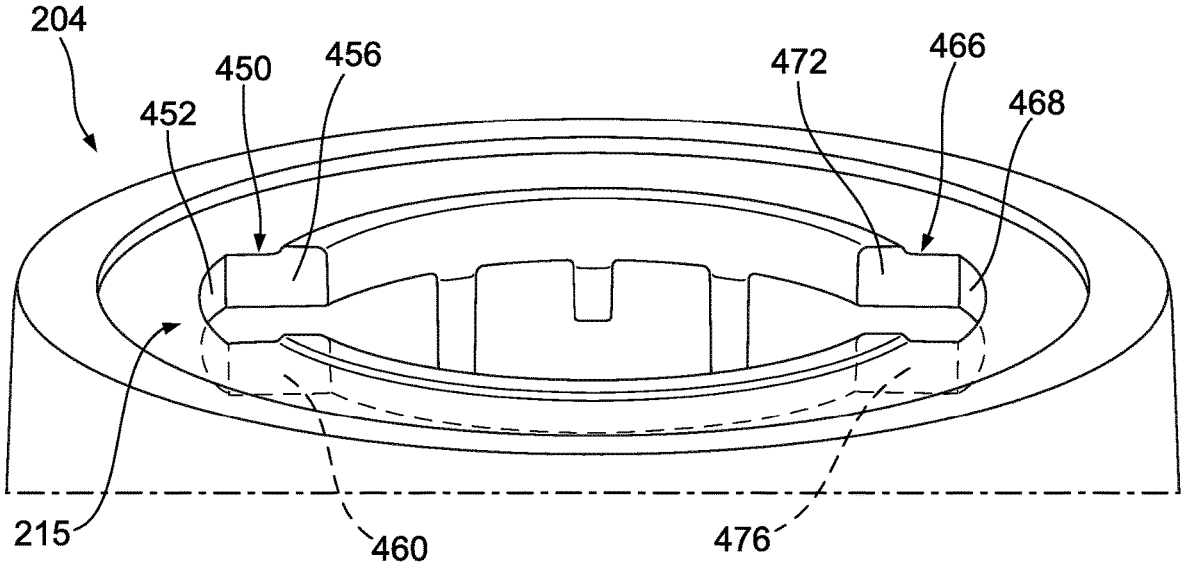
FIG. 12 is a detailed perspective view of a portion of the spray head assembly included in the sprayer in FIG. 3.

Referring to FIGS. 11 and 12, the first biasing member 420 extends from the ratchet 410 and out of the docking housing 252, extending through the docking bottom aperture 260. The first biasing member 420 extends into a cut-out (e.g., divot, void, recess, etc.), shown as a first cut-out 450. The first cut-out 450 is defined cooperatively by the spray annular flange 215 and the spray diverter 202. The first cut-out 450 includes a surface, shown as a first cut face 452. The first cut face 452 is configured to interface with the first biasing member 420 such that the first cut face 452 abuts a surface of the first biasing member 420, shown as a first member face 454. The first member face 454 is contiguous with the first projection ramped surface 426, the first projection flat surface 424, and the first top flange surface 430.

The first cut-out 450 also includes a surface, shown as a first cut first side 456. The first cut first side 456 is contiguous with the first cut face 452. The first cut first side 456 is configured to selectively interface with a surface of the first biasing member 420, shown as a first biasing first side 458. The first biasing first side 458 is contiguous with the first member face 454 and is contiguous with the ratchet inner surface 416.

The first cut-out 450 also includes a surface, shown as a first cut second side 460. The first cut second side 460 is contiguous with the first cut face 452. The first cut second side 460 is configured to selectively interface with a surface of the first biasing member 420, shown as a first biasing second side 462. The first biasing second side 462 is contiguous with the first member face 454 and is contiguous with the ratchet inner surface 416.

The first cut-out 450 also includes at least a portion of the diverter annular surface 356. The diverter annular surface 356 abuts the first cut first side 456 and abuts the first cut second side 460. The diverter annular surface 356 selectively interfaces with the ratchet inner surface 416.

The first cut-out 450 is further configured to receive the first flange 428. The first flange 428 is configured to interface with the spray annular flange 215 such that the first top flange surface 430 abuts the spray flange underside 217.

The second biasing member 434 extends from the ratchet 410 and out of the docking housing 252, extending through the docking bottom aperture 260. The second biasing member 434 extends into a cut-out (e.g., divot, void, etc.), shown as a second cut-out 466. The second cut-out 466 is defined cooperatively by the spray annular flange 215 and the spray diverter 202. The second cut-out 466 includes a surface, shown as a second cut face 468. The second cut face 468 is configured to interface with the second biasing member 434 such that the second cut face 468 abuts a surface of the second biasing member 434, shown as a second member face 470. The second member face 470 is contiguous with the second projection ramped surface 440, the second projection flat surface 438, and the second top flange surface 444.

The second cut-out 466 also includes a surface, shown as a second cut first side 472. The second cut first side 472 is contiguous with the second cut face 468. The second cut first side 472 is configured to selectively interface with a surface of the second biasing member 434, shown as a second biasing first side 474. The second biasing first side 474 is contiguous with the second member face 470 and contiguous with the ratchet inner surface 416.

The second cut-out 466 also includes a surface, shown as a second cut second side 476. The second cut second side 476 is contiguous with the second cut face 468. The second cut second side 476 is configured to selectively interface with a surface of the second biasing member 434, shown as a second biasing second side 478. The second biasing second side 478 is contiguous with the second member face 470 and contiguous with the ratchet inner surface 416.

The second cut-out 466 also includes at least a portion of the diverter annular surface 356. The diverter annular surface 356 abuts the second cut first side 472 and abuts the second cut second side 476. The diverter annular surface 356 selectively interfaces with the ratchet inner surface 416.

The second cut-out 466 is further configured to receive the second flange 442. The second flange 442 is configured to interface with the spray annular flange 215 such that the second top flange surface 444 abuts the spray flange underside 217.

Each of the support members 448 includes a surface, shown as support faces 480. Each of the support faces 480 is configured to interface with the docking housing 252 such that each of the support members 448 is slidably coupled to the docking annular flange 262.

Figure 13:
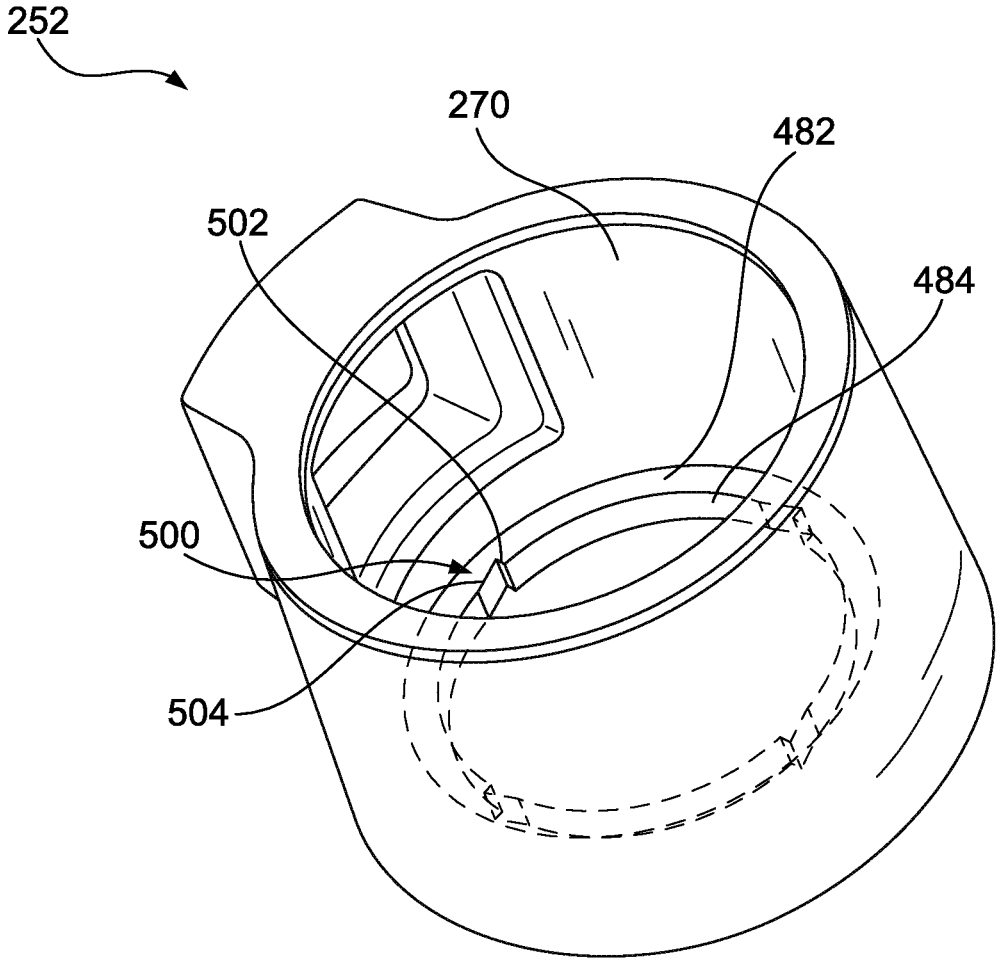
FIG. 13 is a perspective view of a portion of the docking assembly included in the sprayer in FIG. 3.

Referring to FIG. 13, each of the support faces 480 is configured to interface with a surface of the docking annular flange 262, shown as a flange top surface 482. The flange top surface 482 is contiguous with the docking inner surface 270. In some embodiments, the flange top surface 482 is flush with (e.g., completely contacts, is flat against, etc.) each of the support faces 480.

The docking annular flange 262 also includes a surface, shown as a flange annular surface 484. The flange annular surface 484 is contiguous with the flange top surface 482 and with the spray flange underside 217. In some embodiments, the flange annular surface 484 is concentric about the center axis 302. The flange annular surface 484 is configured to interface with the first ramped projection 422 such that the first ramped projection 422 is able to slide across the flange annular surface 484. The flange annular surface 484 may be configured to be in constant contact with the first ramped projection 422. The flange annular surface 484 may apply a force on the first ramped projection 422 such that the first biasing member 420 flexes (e.g., bends, bows, etc.) toward the center axis 302. The flange annular surface 484 is further configured to interface with the second ramped projection 436 such that the second ramped projection 436 is able to slide across the flange annular surface 484. The flange annular surface 484 may be configured to be in constant contact with the second ramped projection 436. The flange annular surface 484 may apply a force on the second ramped projection 436 such that the second biasing member 434 flexes toward the center axis 302. In some embodiments, the flange annular surface 484 does not interface with the spray nut 310 or the spray diverter 202.

The docking annular flange 262 includes a notch, shown as a first notch 500. The first notch 500 is configured to cooperate with the ratchet 410 to facilitate the orientation of the docking assembly 250 relative to the spray head assembly 200. The first notch 500 includes a surface, shown as a first stop face 502. The first stop face 502 is configured to prevent the rotation of the spray head assembly 200 relative to the docking assembly 250 in a single direction (e.g., clockwise, counterclockwise, etc.). The first stop face 502 is configured to interface with at least one of the first projection flat surface 424 or the second projection flat surface 438. The first notch 500 also includes a surface, shown as a first ramp surface 504. The first ramp surface 504 is configured to interface with at least one of the first projection ramped surface 426 or the second projection ramped surface 440. The first stop face 502 is contiguous with the first ramp surface 504 and contiguous with the flange annular surface 484.

Figure 14:
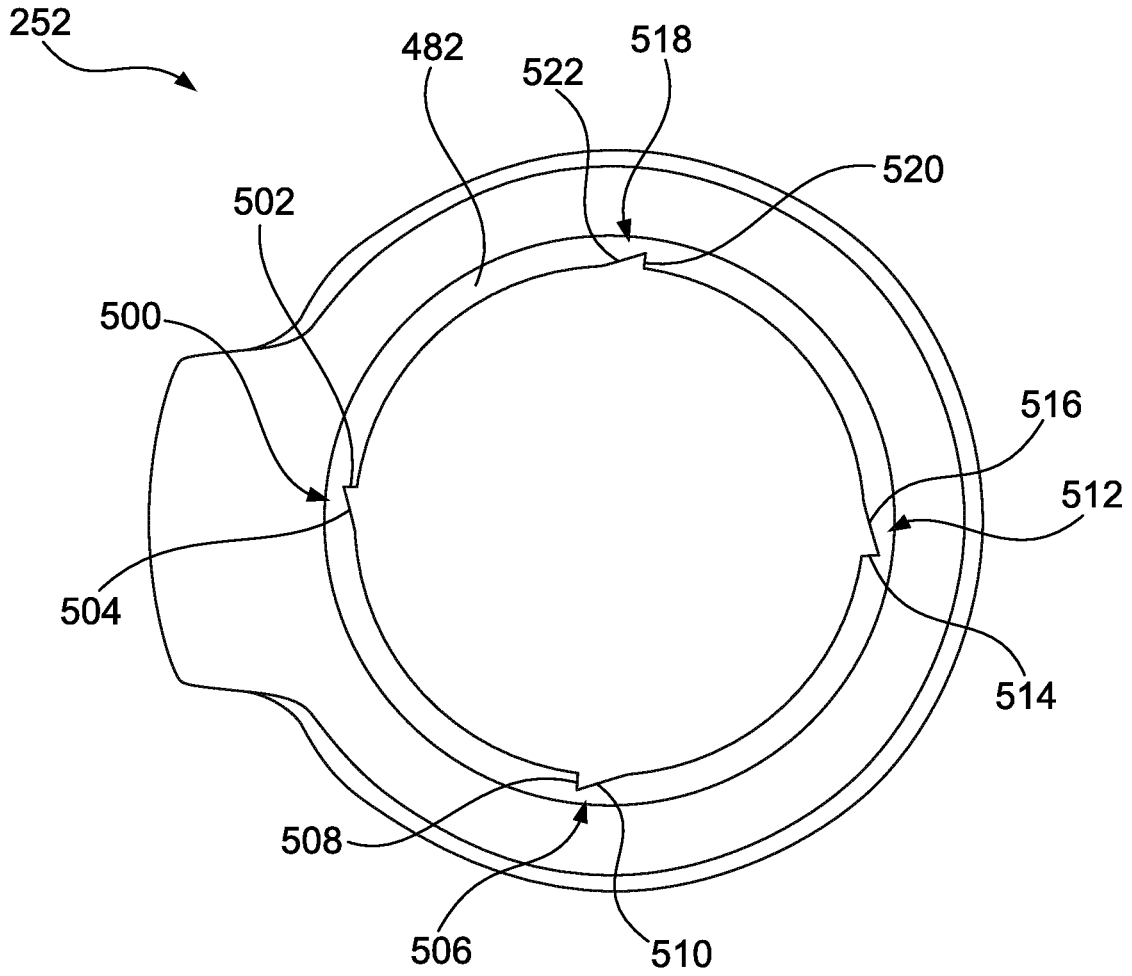
FIG. 14 is a detailed top view of a portion of the docking assembly included in the sprayer of FIG. 3 that interfaces with the spray head assembly of FIG. 3.

Referring to FIG. 14, the docking annular flange 262 also includes a notch, shown as a second notch 506. The second notch 506 is configured to cooperate with the ratchet 410 to facilitate the orientation of the docking assembly 250 relative to the spray head assembly 200. The second notch 506 includes a surface, shown as a second stop face 508. The second stop face 508 is configured to prevent the rotation of the spray head assembly 200 relative to the docking assembly 250 in a single direction (e.g., clockwise, counterclockwise, etc.). The second stop face 508 is configured to interface with at least one of the first projection flat surface 424 or the second projection flat surface 438. The second notch 506 also includes a surface, shown as a second ramp surface 510. The second ramp surface 510 is configured to interface with at least one of the first projection ramped surface 426 or the second projection ramped surface 440. The second stop face 508 is contiguous with the second ramp surface 510 and contiguous with the flange annular surface 484.

The docking annular flange 262 also includes a notch, shown as a third notch 512. The third notch 512 is configured to facilitate the orientation of the docking assembly 250 relative to the spray head assembly 200. The third notch 512 includes a surface, shown as a third stop face 514. The third stop face 514 is configured to prevent the rotation of the spray head assembly 200 relative to the docking assembly 250 in a single direction (e.g., clockwise, counterclockwise, etc.). The third stop face 514 is configured to interface with at least one of the first projection flat surface 424 or the second projection flat surface 438. The third notch 512 also includes a surface, shown as a third ramp surface 516. The third ramp surface 516 is configured to interface with at least one of the first projection ramped surface 426 or the second projection ramped surface 440. The third stop face 514 is contiguous with the third ramp surface 516 and contiguous with the flange annular surface 484.

The docking annular flange 262 also includes a notch, shown as a fourth notch 518. The fourth notch 518 is configured to facilitate the orientation of the docking assembly 250 relative to the spray head assembly 200. The fourth notch 518 includes a surface, shown as a fourth stop face 520. The fourth stop face 520 is configured to prevent the rotation of the spray head assembly 200 relative to the docking assembly 250 in a single direction (e.g., clockwise, counterclockwise, etc.). The fourth stop face 520 is configured to interface with at least one of the first projection flat surface 424 or the second projection flat surface 438. The fourth notch 518 also includes a surface, shown as a fourth ramp surface 522. The fourth ramp surface 522 is configured to interface with at least one of the first projection ramped surface 426 or the second projection ramped surface 440. The fourth stop face 520 is contiguous with the fourth ramp surface 522 and contiguous with the flange annular surface 484.

In some embodiments, when a user rotates the spray head assembly 200 relative to the docking assembly 250, they may rotate the spray head housing 204 counterclockwise relative to the docking assembly 250 from a top-down perspective. The first cut-out 450 and the second cut-out 466 rotate with the spray head housing 204. The first cut-out 450 is configured to apply a force to the first biasing member 420 in the tangent direction of rotation. Likewise, the second cut-out 466 applies a force to the second biasing member 434 in a direction tangent to the rotational force applied by the user. Both the first biasing member 420 and the second biasing member 434 displace in the counterclockwise direction in reference to a top-down perspective.

While the user rotates the spray head housing 204 relative to the docking housing 252, the first ramped projection 422 traverses (e.g., moves, slides, travels, etc.) along the flange annular surface 484 displacing in the counterclockwise direction with the rotation. Also, as the first projection ramped surface 426 traverses along the first ramp surface 504, the first biasing member 420 flexes inward toward the center axis 302. As the first biasing member 420 flexes, the first ramped projection 422 also displaces toward the center axis 302.

Likewise, the second ramped projection 436 is traversing along the flange annular surface 484, displacing in the counterclockwise direction with the rotation. As the second projection ramped surface 440 traverses along the third ramp surface 516, the second biasing member 434 flexes inward toward the center axis 302. As the second biasing member 434 flexes, the second ramped projection 436 also displaces toward the center axis 302.

The rotation of the first biasing member 420 and the second biasing member 434 results in the simultaneous rotation of the ratchet 410. Because the ratchet 410 is rigidly coupled to the spray nut 310, the spray nut 310 simultaneously rotates with the ratchet 410. Because the spray nut 310 is rigidly coupled to the spray diverter 208, the spray diverter 208 also rotates simultaneously. In embodiments where the ornamental spring 129 is coupled to the spray nut 310, the ornamental spring 129 will rotate with the spray nut 310.

The spray hose retainer 300 is not rigidly coupled to the spray nut 310 or the spray diverter 208, so the spray hose retainer 300 does not rotate when the user rotates the spray head assembly 200. Likewise, because the spray hose retainer 300 does not rotate, neither does the spray hose 120. Because the spray hose 120 does not rotate when the spray head housing 204 is rotated, the spray hose 120 does not apply any torque to the spray head housing 204 or the spray head assembly 200.

The spray head assembly 200 has four well-defined orientations relative to the docking assembly 250. In some embodiments, the spray head assembly 200 may have more than four well-defined orientations relative to the docking assembly 250. In other embodiments, the spray head assembly may have fewer than four well-defined orientations relative to the docking assembly 250.

A first orientation of the spray head assembly 200 relative to the docking assembly 250 is defined by the first ramped projection 422 seated (e.g., disposed, located, set, etc.) in the first notch 500 such that the first projection flat surface 424 interfaces the first stop face 502 and the second ramped projection 436 seated in the third notch 512 such that the second projection flat surface 438 interfaces the third stop face 514.

A second orientation of the spray head assembly 200 relative to the docking assembly 250 is defined by the first ramped projection 422 seated in the second notch 506 such that the first projection flat surface 424 interfaces the second stop face 508 and the second ramped projection 436 seated in the fourth notch 518 such that the second projection flat surface 438 interfaces the fourth stop face 520.

A third orientation of the spray head assembly 200 relative to the docking assembly 250 is defined by the first ramped projection 422 seated in the third notch 512 such that the first projection flat surface 424 interfaces the third stop face 514 and the second ramped projection 436 seated in the first notch 500 such that the second projection flat surface 438 interfaces the first stop face 502.

A fourth orientation of the spray head assembly 200 relative to the docking assembly 250 is defined by the first ramped projection 422 seated in the fourth notch 518 such that the first projection flat surface 424 interfaces the fourth stop face 520 and the second ramped projection 436 seated in the second notch 506 such that the second projection flat surface 438 interfaces the second stop face 508.

The user is able to, for example, change the orientation of the spray head assembly 200 relative to the docking assembly 250 from the first orientation to the second orientation by gripping the spray head housing 204 and twisting it counterclockwise relative to the docking housing 252 from a top-down perspective.

Within the first approximately (plus or minus 20%) 45 degrees of rotation of the spray head housing 204 counterclockwise from the first orientation, the first projection flat surface 424 travels away from the first stop face 502 and arrests contact with the first stop face 502. The second projection flat surface 438 moves away from the third stop face 514 and arrests contact with the third stop face 514. The first ramped projection 422 slides along the first ramp surface 504. The mechanical advantage caused by the two wedges displaces the first ramped projection 422 toward the center axis 302. As a result of the displacement of the first ramped projection 422, the first biasing member 420 flexes toward the center axis 302.

At the same time, the second ramped projection 436 slides along the third ramp surface 516. The mechanical advantage caused by the two wedges displaces the second ramped projection 436 toward the center axis 302. As a result of the displacement of the second ramped projection 436, the second biasing member 434 flexes toward the center axis 302. The ratchet inner surface 416 may interface with the diverter annular surface 356 during the rotation.

Approximately 45 degrees into the rotation of the spray head assembly 200 relative to the docking assembly 250, the first ramped projection 422 no longer interfaces with the first ramp surface 504. The first ramped projection 422 now contacts the flange annular surface 484 and is sliding along the flange annular surface 484 in a counterclockwise direction from a top-down perspective. The second ramped projection 436 no longer interfaces with the third ramp surface 516. The second ramped projection 436 now contacts the flange annular surface 484 and is sliding along the flange annular surface 484 in a counterclockwise direction from a top-down perspective.

Approximately 90 degrees into the rotation of the spray head assembly 200 relative to the docking assembly 250, the first projection flat surface 424 passes over the second stop face 508. The force from the flex in the first biasing member 420 causes the first ramped projection 422 to move radially outward from the center axis 302 and into the second notch 506. More specifically, the first ramped projection 422 is seated in the second notch 506 when the first projection flat surface 424 interfaces the second stop face 508 and the first projection ramped surface 426 interfaces the second ramp surface 510. This movement of the first ramped projection 422 into the second notch 506 may cause a click sound, signifying to the user that the second orientation has been achieved.

The second projection flat surface 438 passes over the fourth stop face 520. The force from the flex in the second biasing member 434 cause the second ramped projection 436 to move radially outward from the center axis 302 and into the fourth notch 518. More specifically, the second ramped projection 436 is seated in the fourth notch 518 when the second projection flat surface 438 interfaces with the fourth stop face 520 and the second projection ramped surface 440 interfaces with the fourth ramp surface 522. This movement of the second ramped projection 436 into the fourth notch 518 may cause a click sound, signifying to the user that the second orientation has been achieved.

Should the user try to rotate the spray head housing 204 clockwise relative to the docking housing 252 from a top-down perspective (e.g., attempt to go from the second orientation to the first orientation without first passing through the third orientation and the fourth orientation), the first projection flat surface 424 will interface with the second stop face 508. The second stop face 508 will push back against the first projection flat surface 424, not allowing for movement in the clockwise direction. Likewise, should the user try to rotate the spray head housing 204 clockwise relative to the docking housing 252 from a top-down perspective, the second projection flat surface 438 will interface with the fourth stop face 520. The fourth stop face 520 will push back against the second projection flat surface 438, not allowing for movement in the clockwise direction. In short, an attempt to rotate the spray head housing 204 clockwise relative to the docking housing 252 from a top-down perspective will result in the simultaneous rotation of the docking housing 252.

Figure 15:
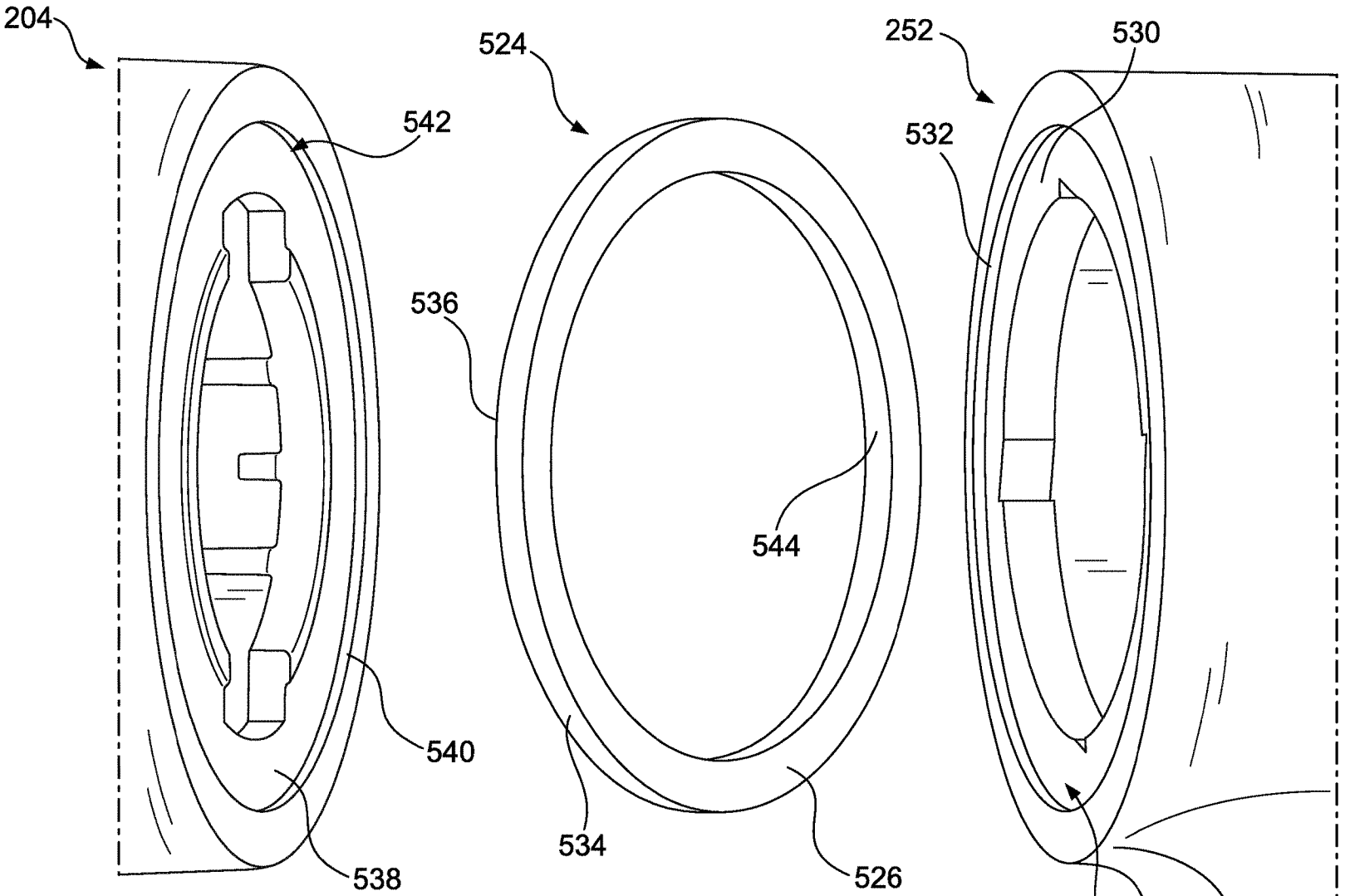
FIG. 15 is an exploded perspective view of the interface between the spray head assembly and the docking assembly of FIG. 3.

Referring to FIG. 15, the rotation of the spray head housing 204 relative to the docking housing 252 can cause wear at the contact points between the spray head housing 204 and the docking housing 252. To facilitate this wear, the sprayer 128 includes an annular body, shown as a wear washer 524. The wear washer 524 is disposed between the docking housing 252 and the spray head housing 204.

The wear washer 524 includes a surface, shown as a top washer surface 526. The top washer surface 526 is configured to interface with the docking annular flange 262 such that slipping is allowed between the wear washer 524 and the docking housing 252. In some embodiments, the wear washer 524 is configured to rotate about the center axis 302 relative to the docking housing 252.

The docking annular flange 262 includes a groove, shown as a docking washer groove 528. The docking washer groove 528 is configured to accept the wear washer 524. The docking washer groove 528 includes a surface, shown as a docking groove first surface 530. The docking groove first surface 530 is configured to interface with the top washer surface 526. In some embodiments, the top washer surface 526 sits flush on the docking groove first surface 530.

The docking washer groove 528 also includes a surface, shown as an docking groove second surface 532. The docking groove second surface 532 is contiguous with the docking groove first surface 530. The docking groove second surface 532 is configured to interface with a surface of the wear washer 524, shown as an outer washer surface 534. At least a portion of the outer washer surface 534 is configured to interface with the docking groove second surface 532. The docking groove second surface 532 is configured to prevent the wear washer 524 from moving translationally relative to the docking housing 252.

The wear washer 524 is also configured to interface with the spray head housing 204 such that the wear washer 524 is able to move relative to the spray head housing 204. In some embodiments, the wear washer 524 is configured to rotate about the center axis 302 while interfacing with the spray head housing 204. The wear washer 524 includes a surface, shown as a bottom washer surface 536. The bottom washer surface 536 is contiguous with the outer washer surface 534. The bottom washer surface 536 is configured to interface with a surface on the spray head housing 204, shown as a spray groove first surface 538. The spray groove first surface 538 interfaces the bottom washer surface 536 such that slipping is able to occur between the spray groove first surface 538 and the bottom washer surface 536.

The spray head housing 204 also includes a surface, shown as an spray groove second surface 540. The spray groove second surface 540 is contiguous with the spray groove first surface 538. The spray groove second surface 540 is configured to interface the outer washer surface 534 such that the spray head housing 204 is not able to move translationally relative to the wear washer 524, but is able to rotate about the center axis 302 relative to the wear washer 524.

The spray groove second surface 540 and the spray groove first surface 538 cooperate to define a groove, shown as a spray head washer groove 542. The spray head washer groove 542 is configured to accept the wear washer 524.

The wear washer 524 also includes a surface, shown as a inner washer surface 544. The inner washer surface 544 is contiguous with the bottom washer surface 536 and the top washer surface 526. The inner washer surface 544 is configured such that the inner washer surface 544 is unable to interface with the spray nut 310 or the spray diverter 202.

The wear washer 524 is configured to separate the spray head housing 204 and the docking housing 252 such that the spray head housing 204 and the docking housing 252 are arrested from interfacing. In other embodiments, the spray head housing 204 and the docking housing 252 are configured to interface.

IV. Configuration of Exemplary Embodiments

As utilized herein, the terms "about," "parallel," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims. It is understood that the term "parallel" is intended to encompass de minimus variations as would be understood to be within the scope of the disclosure by those of ordinary skill in the art.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure.

The terms "coupled," "connected," "fastened," "attached," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "upper," etc.) are merely used to describe the orientation of various elements in the FIGURES. It should be noted that the orientation of various elements may differ according to other exemplary embodiments and that such variations are intended to be encompassed by the present disclosure. For example, while the faucet 100 has been illustrated as a semi-professional faucet, it is understood that the faucet 100 may also be a centerset faucet.

The construction and arrangement of the elements of the faucet 100, the spray head assembly 200, the docking assembly 250, and all other elements and assemblies as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X; Y; Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

What is claimed is:

1. A faucet comprising:

a spout;

a spray hose partially contained within the spout and extending from the spout;

a support arm coupled to the spout and extending from the spout; and a sprayer comprising:

a docking assembly removably coupled to the support arm; and a spray head assembly rotatably coupled to the spray hose, rotatably coupled to the docking assembly, and rotatable relative to the spray hose while the spray head assembly is rotatably coupled to the spray hose;

wherein the docking assembly is configured to facilitate rotation of the spray head assembly relative to the docking assembly.

2. The faucet of claim 1, further comprising a wear washer, wherein the wear washer is configured to interface with the spray head assembly and the docking assembly during rotation of the spray head assembly relative to the docking assembly.

3. The faucet of claim 1, further comprising a ratchet, wherein the ratchet is configured to cooperate with the docking assembly to facilitate rotation of the spray head assembly relative to the docking assembly.

4. The faucet of claim 3, wherein the ratchet comprises a first biasing member that extends from the docking assembly to the spray head assembly.

5. The faucet of claim 4, wherein the ratchet selectively rotatably couples the spray head assembly to the docking assembly.

6. The faucet of claim 4, wherein:

the first biasing member further comprises a first projection; and the first projection is configured to interface with the docking assembly to arrest rotation of the spray head assembly relative to the docking assembly in only a rotational direction.

7. A faucet comprising:

a spout;

a spray hose partially contained within the spout and extending from the spout;

a support arm coupled to the spout and extending from the spout; and a sprayer comprising:

a docking assembly removably coupled to the support arm; and a spray head assembly rotatably coupled to the spray hose and rotatably coupled to the docking assembly;

wherein the spray head assembly is rotatable relative to the spray hose while the spray head assembly is rotatably coupled to the spray hose;

wherein the docking assembly is configured to facilitate rotation of the spray head assembly relative to the spray hose; and wherein the spray head assembly is rotatable relative to the docking assembly without axial movement of the spray head assembly relative to the docking assembly and without translational movement of the spray head assembly relative to the docking assembly.

8. The faucet of claim 7, where in the docking assembly is rotatable without a simultaneous rotation of the spray hose.

9. The faucet of claim 7, wherein the spray head assembly is rotatable relative to the docking assembly while the docking assembly is coupled to the support arm.

10. The faucet of claim 7, wherein the spray head assembly is rotatable relative to the docking assembly while the docking assembly is not coupled to the support arm.

11. The faucet of claim 7, further comprising an external spring, wherein the spray hose extends through the external spring and the external spring is positioned between the sprayer and the spout.

12. The faucet of claim 7, wherein the docking assembly is configured to be selectively rotated and subsequently coupled with the support arm in a plurality of target rotational orientations with respect to the support arm.

13. The faucet of claim 12, further comprising an external spring, wherein the external spring is rotatably coupled to the spray head assembly such that the rotation of the spray head assembly relative to the docking assembly does not cause simultaneous rotation of the external spring.

14. The faucet of claim 7, wherein:

the docking assembly is further configured to establish a plurality of orientations of the spray head assembly within the docking assembly; and the spray head assembly is configured to be held by the docking assembly in one of the plurality of orientations.

15. The faucet of claim 7, wherein the docking assembly is further configured to only facilitate rotation of the spray head assembly in a single rotational direction relative to the docking assembly.

16. A sprayer comprising:

a docking assembly comprising a retention device; and a spray head assembly configured to be rotatably coupled to a spray hose, rotatably coupled to the docking assembly, and rotatable relative to the spray hose while the spray head assembly is rotatably coupled to the spray hose;

wherein the docking assembly is configured to facilitate rotation of the spray head assembly relative to the docking assembly.

17. The sprayer of claim 16, wherein rotation of the spray head assembly relative to the docking assembly requires rotation of the docking assembly in a first rotational direction and simultaneous rotation of the spray head assembly in a second rotational direction, the second rotational direction being opposite to the first rotational direction.

18. The sprayer of claim 16, wherein the spray hose is configured to not be axially translated relative to the spray head assembly while the spray head assembly rotates relative to the docking assembly.

19. The sprayer of claim 16, wherein:

the spray head assembly further comprises a function button; and the function button is configured to rotate simultaneously with the spray head assembly.

20. The sprayer of claim 19, wherein:

the spray head assembly further comprises a function toggle; and the function toggle is configured to rotate simultaneously with the spray head assembly.

* * * * *